US008201362B2

(12) United States Patent
Alford et al.

(10) Patent No.: US 8,201,362 B2
(45) Date of Patent: Jun. 19, 2012

(54) FOLDABLE ENCLOSURE

(75) Inventors: Arnold Alford, MacMasters Beach (AU); John Demartins, MacMasters Beach (AU); Razvan Gornoviceanu, MacMasters Beach (AU)

(73) Assignee: SmarTech Designs Pty Limited, New South Wales (AU)

( * ) Notice: Subject to any disclaimer, the term of this patent is extended or adjusted under 35 U.S.C. 154(b) by 0 days.

(21) Appl. No.: 12/312,989

(22) PCT Filed: Dec. 4, 2007

(86) PCT No.: PCT/AU2007/001864
§ 371 (c)(1),
(2), (4) Date: Apr. 12, 2010

(87) PCT Pub. No.: WO2008/067592
PCT Pub. Date: Jun. 12, 2008

(65) Prior Publication Data

US 2011/0126479 A1 Jun. 2, 2011

(30) Foreign Application Priority Data

Dec. 5, 2006 (AU) ..... 2006906800

(51) Int. Cl.
*E04B 1/346* (2006.01)
*E04B 7/16* (2006.01)

(52) U.S. Cl. ..... 52/69; 52/64; 52/65; 52/66; 52/67; 52/68; 52/70; 52/71; 52/72

(58) Field of Classification Search ..... 52/64–72
See application file for complete search history.

(56) References Cited

U.S. PATENT DOCUMENTS 3,792,557 A * 2/1974 Pitts ..... 52/65
4,741,133 A * 5/1988 Kutzner ..... 52/79.5
4,989,379 A 2/1991 Suzuki
(Continued)

FOREIGN PATENT DOCUMENTS

WO 99/64688 12/1999
(Continued)

*Primary Examiner* — William Gilbert
*Assistant Examiner* — Mark Wendell
(74) *Attorney, Agent, or Firm* — Jacobson Holman PLLC

(57) ABSTRACT

The present invention provides a foldable enclosure intending as a building or portion of a building that may be transported to a desired site in a folded configuration and then expanded into its intended form. The enclosure has a floor and two wall or roof support section extending upwardly from opposed sides of the floor section. A first roof section spans across the gap between the wall or roof support sections. At least a second roof section in provided that is pivotally mounted to the structure to overlie the first roof section in transit and fold out to extend outwardly substantially in plane with the first roof section in the expanded form. Similarly, second floor sections may be pivotally mounted to lie adjacent the wall/roof support sections in transit and extend outwardly substantially in plane with the first floor section when expanded. A further wall section may be pivotally connected to the end of the second floor section so that it may lie parallel and adjacent the second floor section in transit and extend upwardly from the second floor section when expanded to interconnect with the expanded roof and complete the enclosure. In the preferred form the structure includes a third roof section pivotally mounted to the second roof section to further extend the roof in the expanded configuration to meet and connect with the further wall section.

8 Claims, 37 Drawing Sheets

U.S. PATENT DOCUMENTS

| | | | | |
|---|---|---|---|---|
| 5,237,784 | A * | 8/1993 | Ros | 52/79.5 |
| 5,444,944 | A * | 8/1995 | Roelofsz | 52/64 |
| 5,461,832 | A | 10/1995 | Smith | |
| 5,661,930 | A * | 9/1997 | Porter | 52/64 |
| 6,223,479 | B1 | 5/2001 | Stockli | |
| 6,902,061 | B1 * | 6/2005 | Elstone | 206/600 |
| 7,117,645 | B2 * | 10/2006 | Bzorgi | 52/79.5 |
| 7,882,659 | B2 * | 2/2011 | Gyory et al. | 52/79.5 |
| 2007/0245637 | A1 * | 10/2007 | Czyznikiewicz | 52/71 |
| 2009/0218343 | A1 * | 9/2009 | Mow et al. | 220/6 |

FOREIGN PATENT DOCUMENTS

| | | |
|---|---|---|
| WO | 02/066755 | 8/2002 |

* cited by examiner

1

FOLDABLE ENCLOSURE

This is a national stage of PCT/AU07/001,864 filed Dec. 4, 2007 and published in English, which has a priority of Australia no. 2006906800 filed Dec. 5, 2006, hereby incorporated by reference.

FIELD OF THE INVENTION

The present invention relates to a foldable enclosure and, in particular but not exclusively to, a house that can be transported in a folded configuration and expanded at a destination site.

BACKGROUND TO THE INVENTION

Fixed and mobile enclosures of all shapes and sizes are utilised throughout the world. Considerable time and expense is involved in the construction of an enclosure of any substantial size. A house for example is complicated to construct and requires the cooperation of many different skilled tradesmen. In some areas of the world, it is also difficult to locate suitable tradesmen.

Referring particularly to dwellings, construction time is typically limited to a minimum of three months. The coordination of independent tradesmen in conjunction with fluctuating weather conditions and varying environments, adds considerable time to the construction. As tradesman are typically under pressure to complete a job in the quickest possible time, poor workmanship, miscalculation and human errors occur. Workplace related accidents could also occur due to time pressures and manually fabricating and erecting parts on site. Delays in construction also occur when materials are delivered late or inconsistently and faulty or incorrect products are supplied. On worksites it is also common for tools and materials to go missing.

There is a need for an enclosure, such as a dwelling, that can be constructed in a factory where the above problems would not occur, folded into a container, shipped to a destination site and then unfolded into an expanded configuration as quickly as possible.

OBJECT OF THE INVENTION

It is an object of the present invention to substantially overcome or at least ameliorate one or more of the disadvantages of the prior art, or to at least provide a useful alternative.

SUMMARY OF THE INVENTION

Accordingly, in a first aspect, the invention consists in a foldable enclosure that is to be in a folded configuration during transport to a destination site where the enclosure is to be placed in an expanded configuration; said enclosure including:

a floor;

at least one wall extending upwardly from the floor; and a roof assembly supported on the wall and spaced upwardly from the floor, the roof assembly including:

a first roof portion extending laterally from the wall in a first direction having a horizontal direction component, a second roof portion pivotally mounted for angular movement about a generally horizontal axis for movement between a folded transport configuration where the second roof portion at least substantially overlays the first roof portion, and an expanded configuration where the second roof portion extends laterally relative to the wall in a direction opposite said direction component.

Accordingly, in a second aspect, the invention consists in a foldable enclosure that is to be in a folded configuration during transport to a destination site where the enclosure is to be placed in an expanded configuration; said enclosure comprising:

a first floor section at least two roof support sections connected to said floor adjacent opposed sides of said first floor section and extending substantially perpendicular from said floor;

a first roof section connected to ends, distal from said floor, of said at least two roof support sections and spanning across a distance between said two roof support sections at least one second roof section pivotally connected to said first roof section or said roof support section and movable between a folded configuration in which said second roof section substantially overlies said first roof section and an expanded configuration in which said second roof section lies substantially in plane with said first roof section and extending in an opposed direction to that of said first roof section from an adjacent end of said roof support section at least one second floor section pivotally connected to or adjacent said side of said first floor section and movable between a folded configuration in which said second roof section lies substantially adjacent said roof support section and an expanded configuration in which said second floor section lies substantially in plane with said first floor section and extending in an opposed direction to that of said first floor section from an adjacent end of said roof support section; and at least one wall section pivotally connected to second floor section at an end of said floor section distal from that connected to or adjacent said first floor section and movable between a folded configuration in which said wall section lies substantially adjacent said second floor section and an expanded configuration in which said wall section extends perpendicular from an end of said second floor section to interconnect with an expanded roof section.

BRIEF DESCRIPTION OF THE DRAWINGS

Preferred embodiments of the present invention will now be described, by way of example only, with reference to the accompanying drawings in which.

DETAILED DESCRIPTION OF PREFERRED EMBODIMENTS

Figure 1:
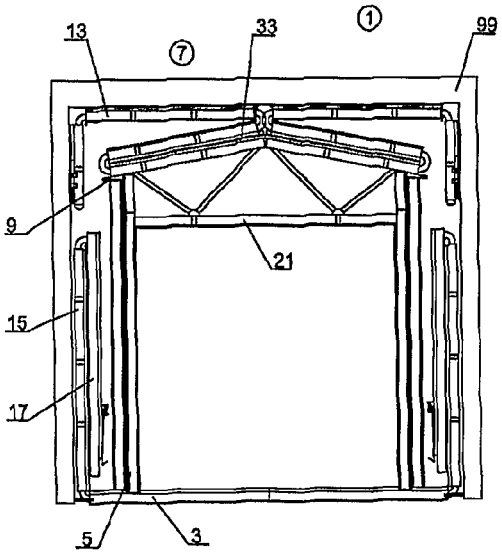
FIGS. 1 to 9 show cutaway side views of the foldable enclosure of the present invention from a folded configuration to an expanded configuration.
Figure 2:
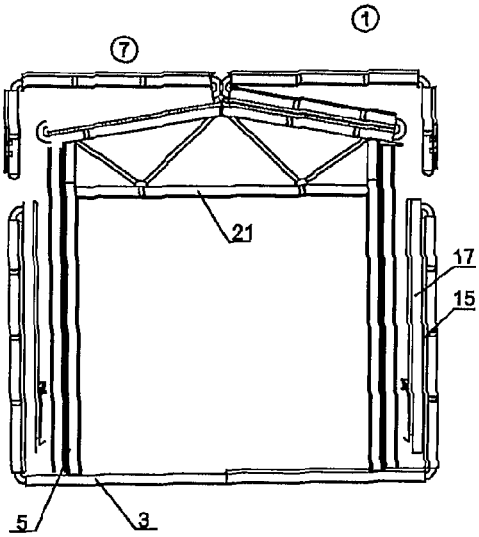
Figure 3:
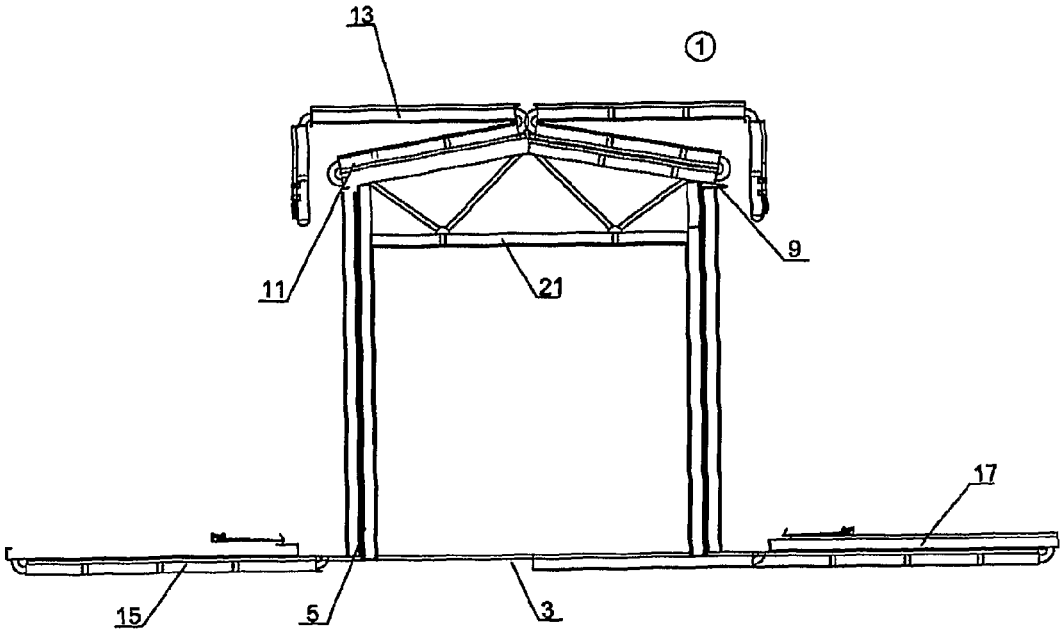
Figure 4:
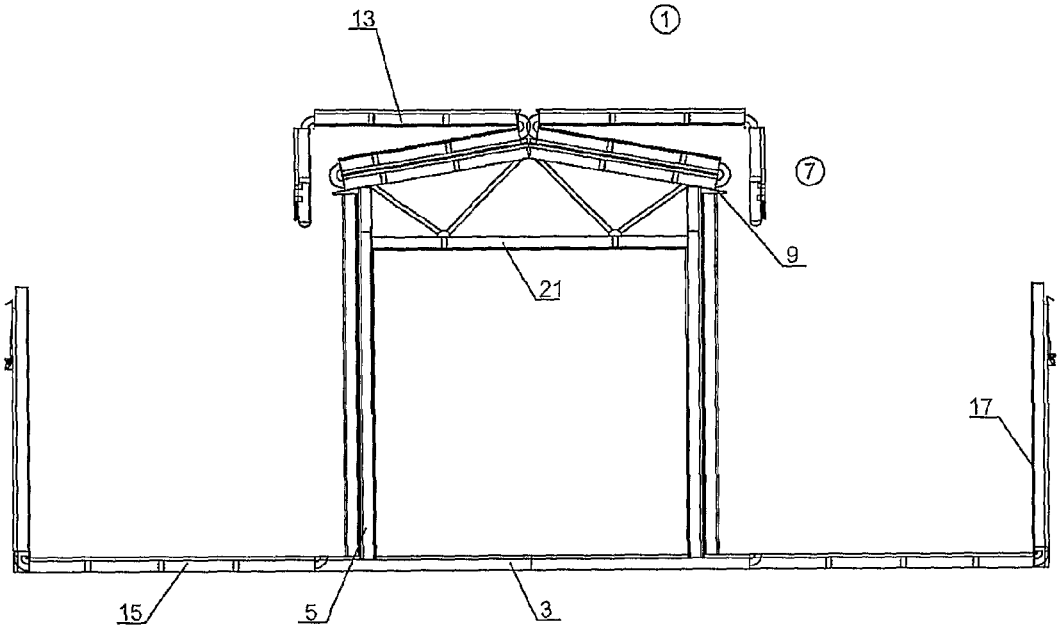
Figure 5:
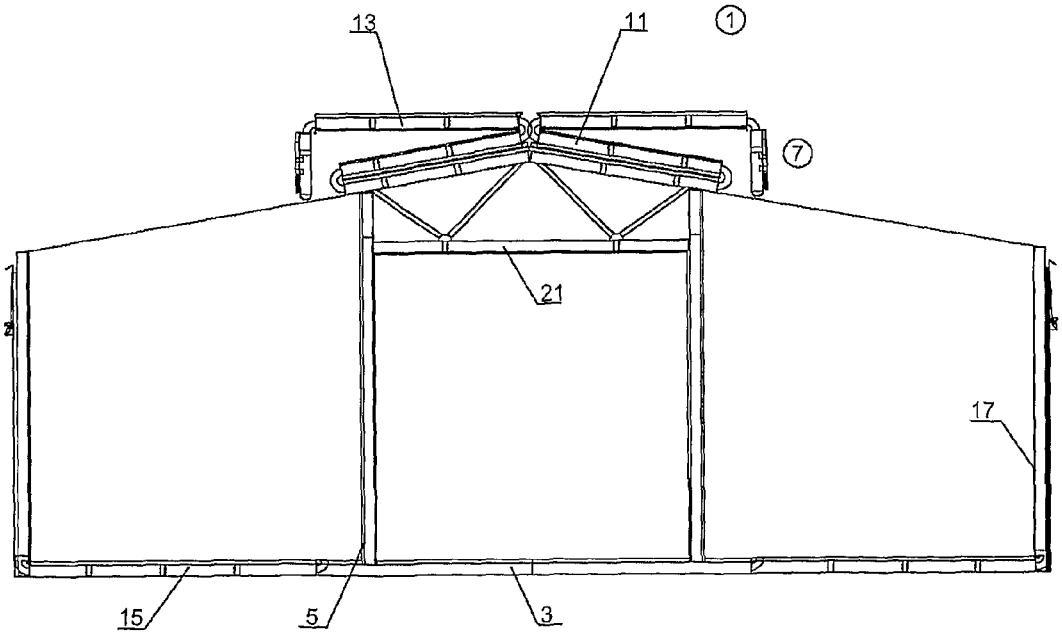
Figure 6:
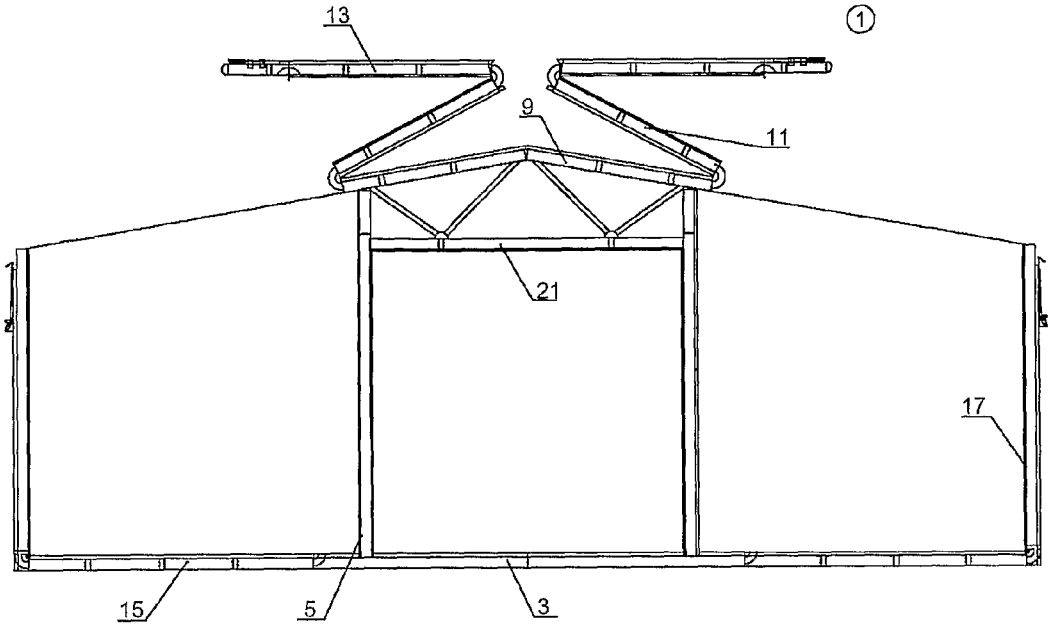
Figure 7:
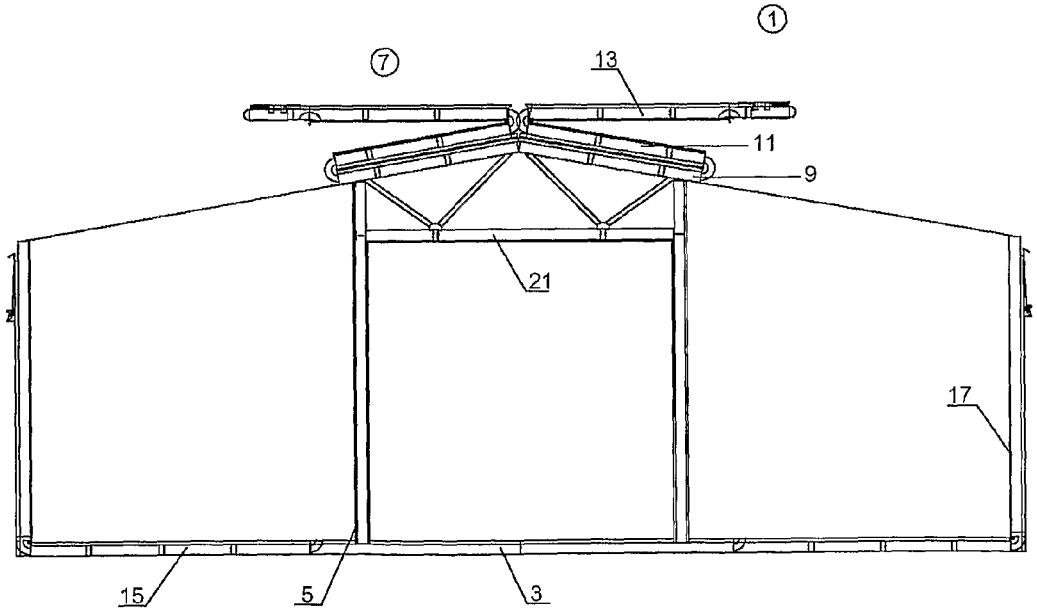

In the accompanying drawings, and as best seen in FIGS. 1 to 9 there is schematically depicted a foldable enclosure 1 having a floor 3, at least one wall 5 extending upwardly from the floor 3 and a roof assembly 7 supported on the wall 5 and spaced upwardly from the floor 3. The roof assembly 7 includes a first roof portion 9 extending laterally from the wall 5 in a first direction having a horizontal direction component, a second roof portion 11 pivotally mounted to the first roof portion 9 for angular movement relative thereto about a generally horizontal axis. A third roof portion 13 pivotally mounted to the second roof portion 11 for angular movement relative thereto about a generally horizontal axis.

Figure 8:
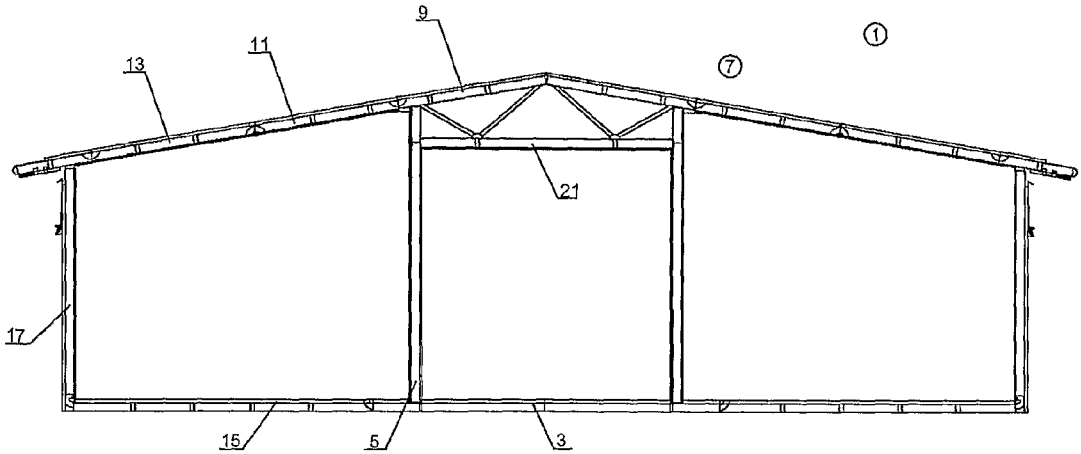
Figure 9:
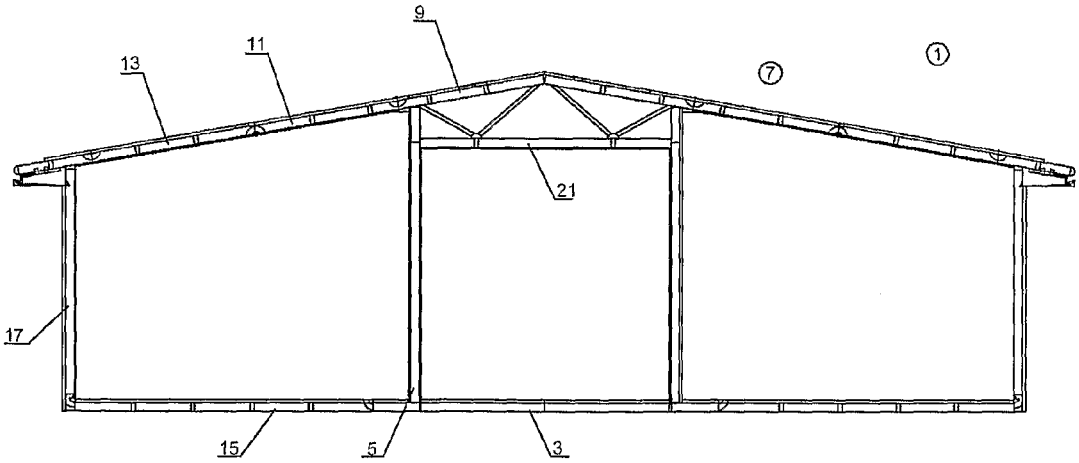

The floor 3 in a preferred form is a first floor section 3 and the enclosure 1 includes a second floor section 15 pivotally mounted to the first floor section 3 for angular movement relative thereto about a generally horizontal axis. The wall 5 in a preferred form is a first wall 5 and the enclosure 1 further includes a second wall 17 pivotally mounted to the second floor section 15 for angular movement relative thereto about a generally horizontal axis. Enclosure 1 includes means 19 to fixably connect the third roof portion 13 to the second wall 17 as best seen in FIGS. 8 to 10.

Roof assembly 7 further includes a truss 21 to support roof portions 9, 11 and 13. In a preferred form the truss 21 is hinged to a wall 5 to provide a hinged truss. One of the roof portions 9, 11 and 13 (and in the preferred form the third roof portion 13) includes a lifting mechanism 23 as best seen in FIGS. 10, 11A to 11C. The lifting mechanism 23 includes a longitudinally extending arm 25 for mounting by way of mounting brackets 27 to an underside 29 of the third roof portion 13. The arm 25 includes a lifting part 31 pivotally mounted to the arm 25 adjacent an end 33 of the third roof portion 13 for angular movement relative thereto about a generally horizontal axis. The lifting part 31 in a preferred form includes a slot 35 extending along the longitudinal length of the part 31 to cooperate with a pin 37 located on the arm 25. The slot 35 can pivot about the pin 37. The lifting part 31 further includes an aperture 39 for connection to lifting means in the form of a crane (not shown).

Figure 15A:
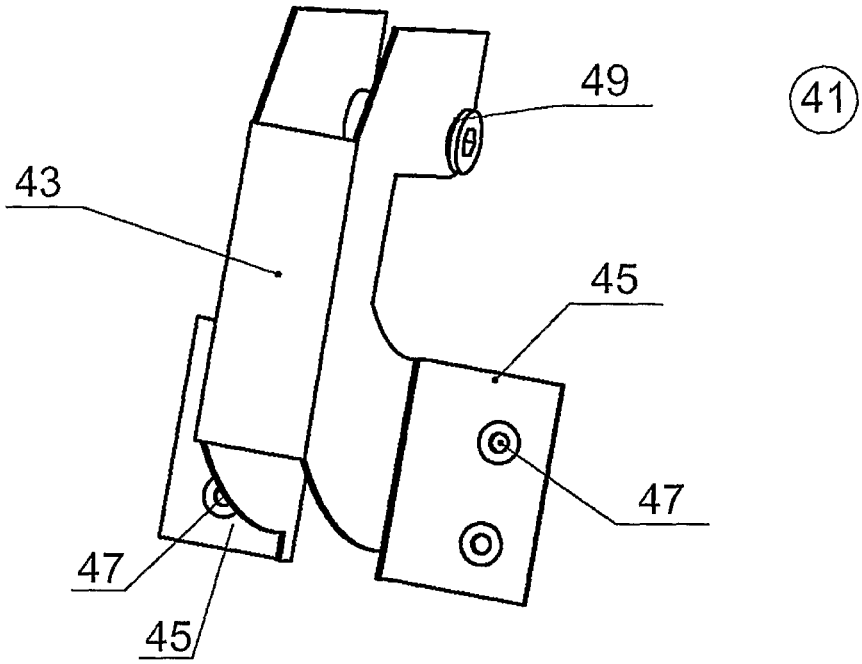
FIGS. 15A and 15B show a wall/floor hinge for use in the present invention.
Figure 15B:
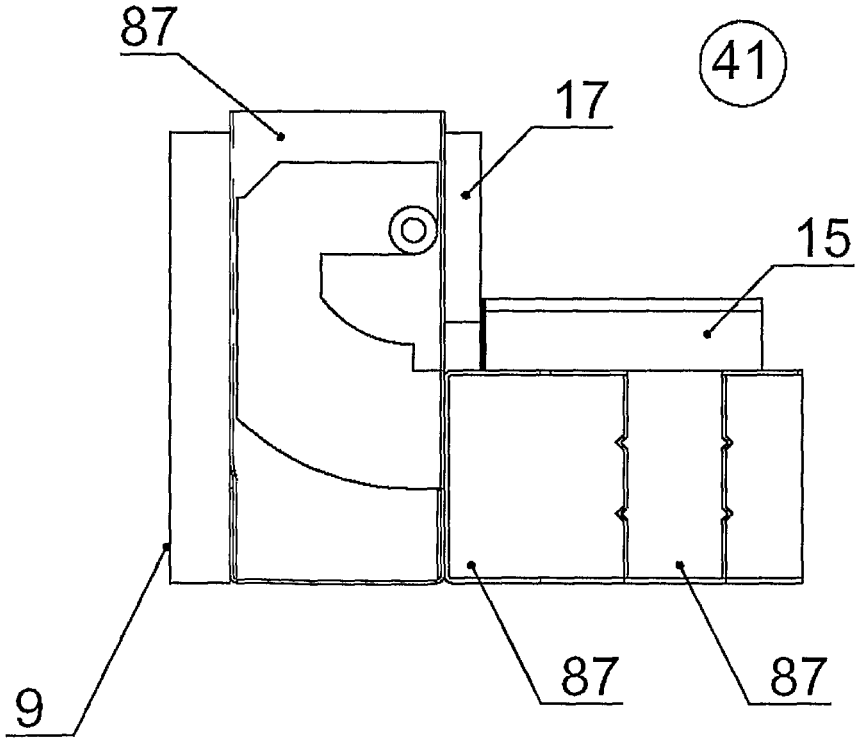
Figure 16A:
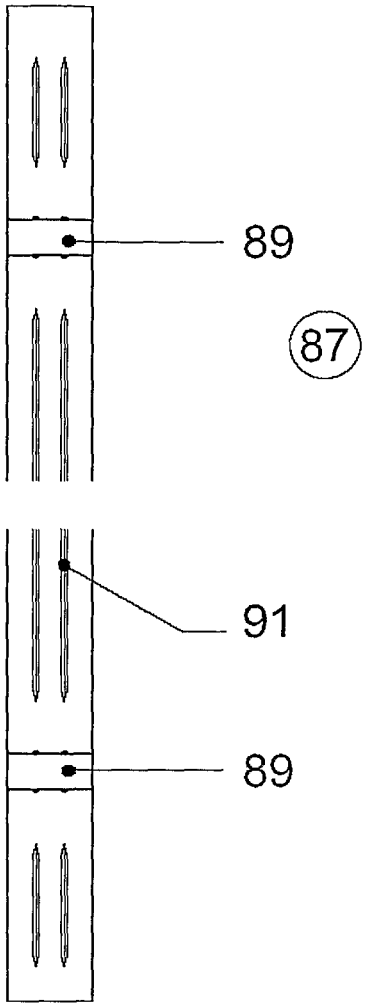
FIGS. 16A to 16E show structural members for use in the present invention.
Figure 16B:
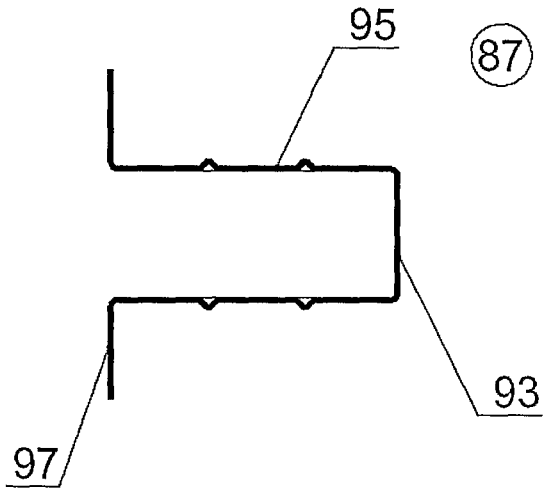
Figure 16C:
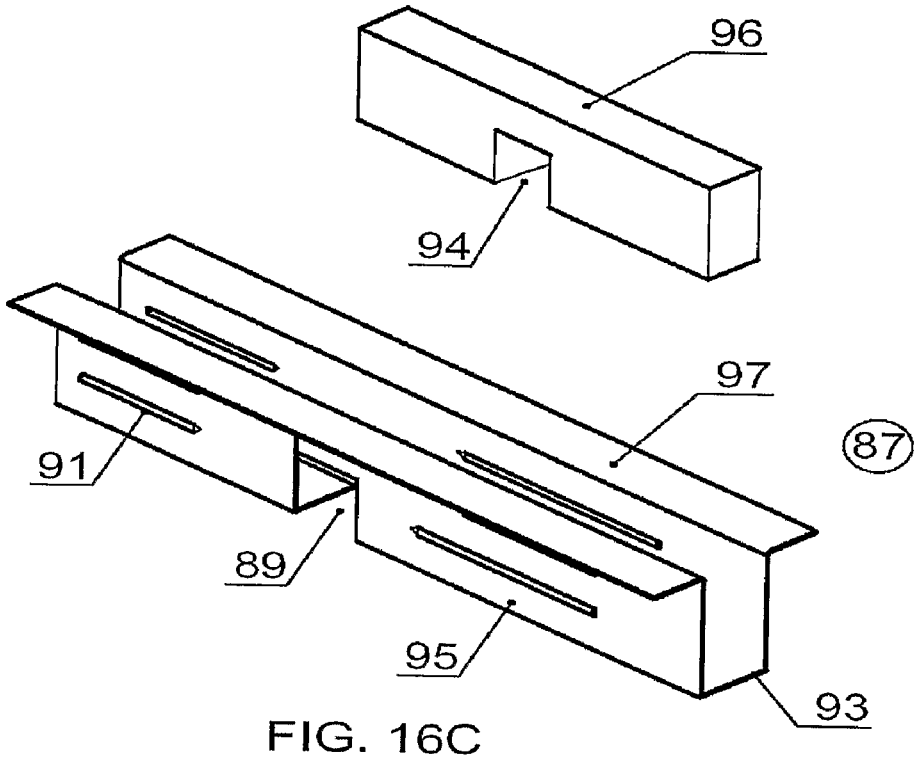
Figure 16D:
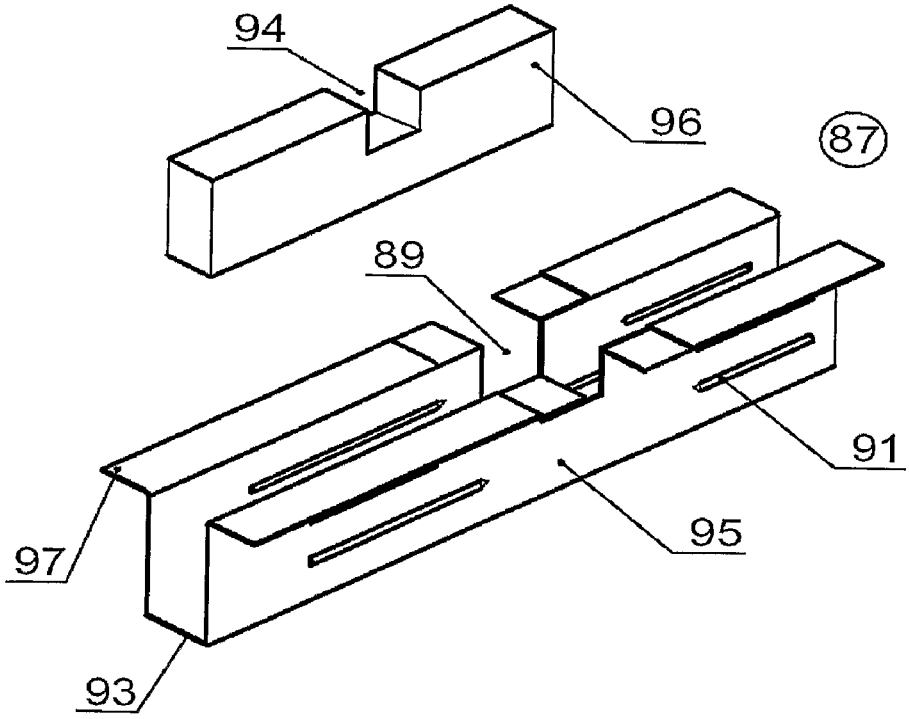
Figure 16E:
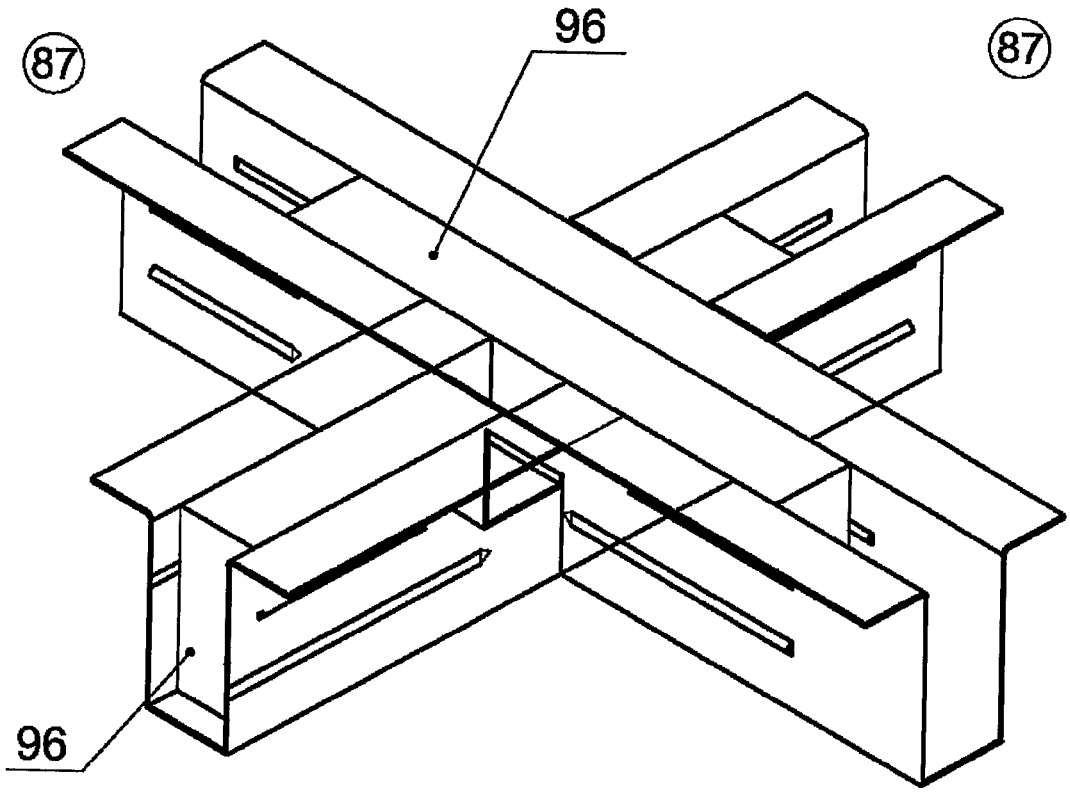
Figure 17A:
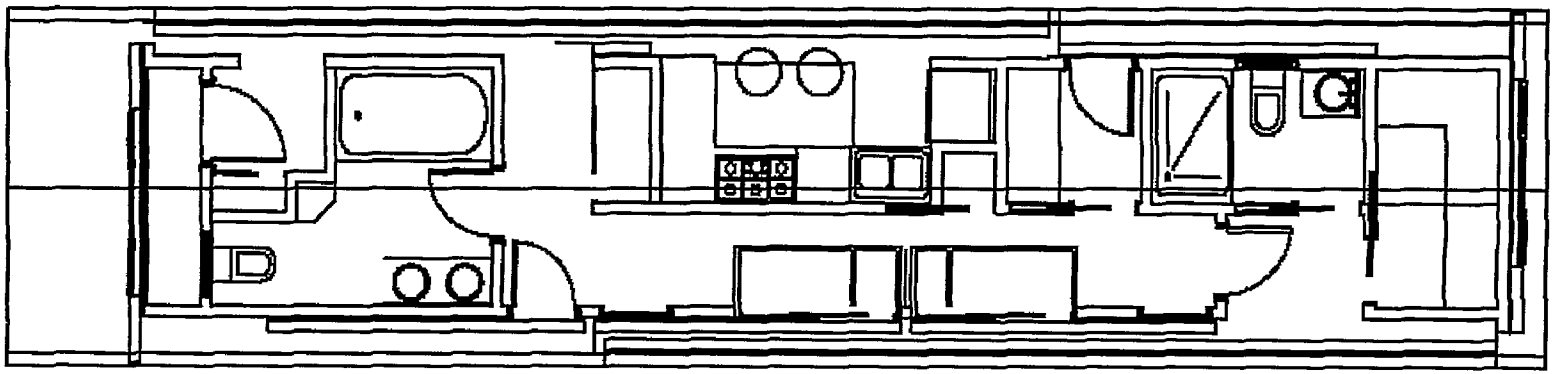
FIGS. 17A to 17G show plan and side views of an enclosure of the present invention from a folded configuration to an expanded configuration.
Figure 17B:
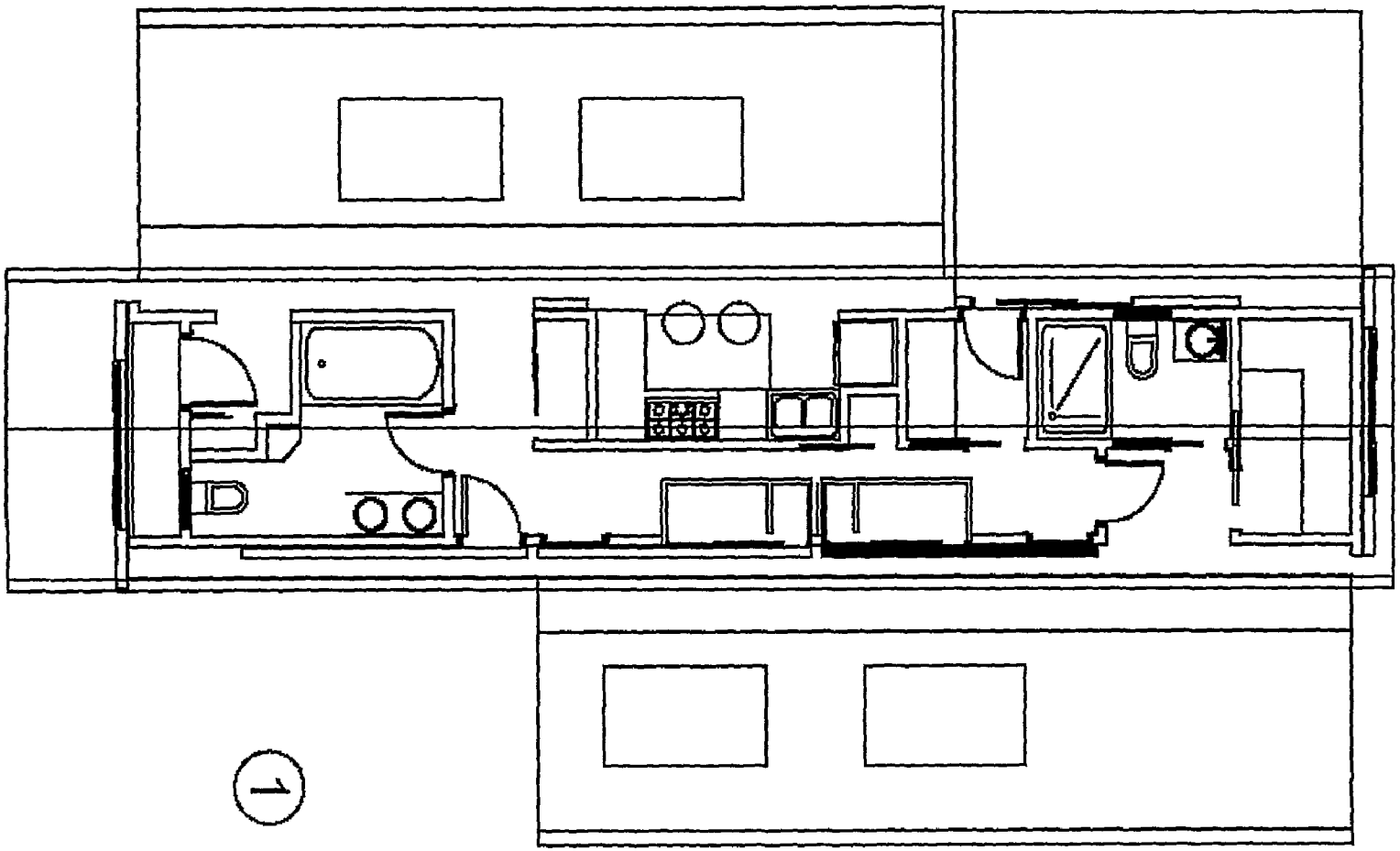
Figure 17C:
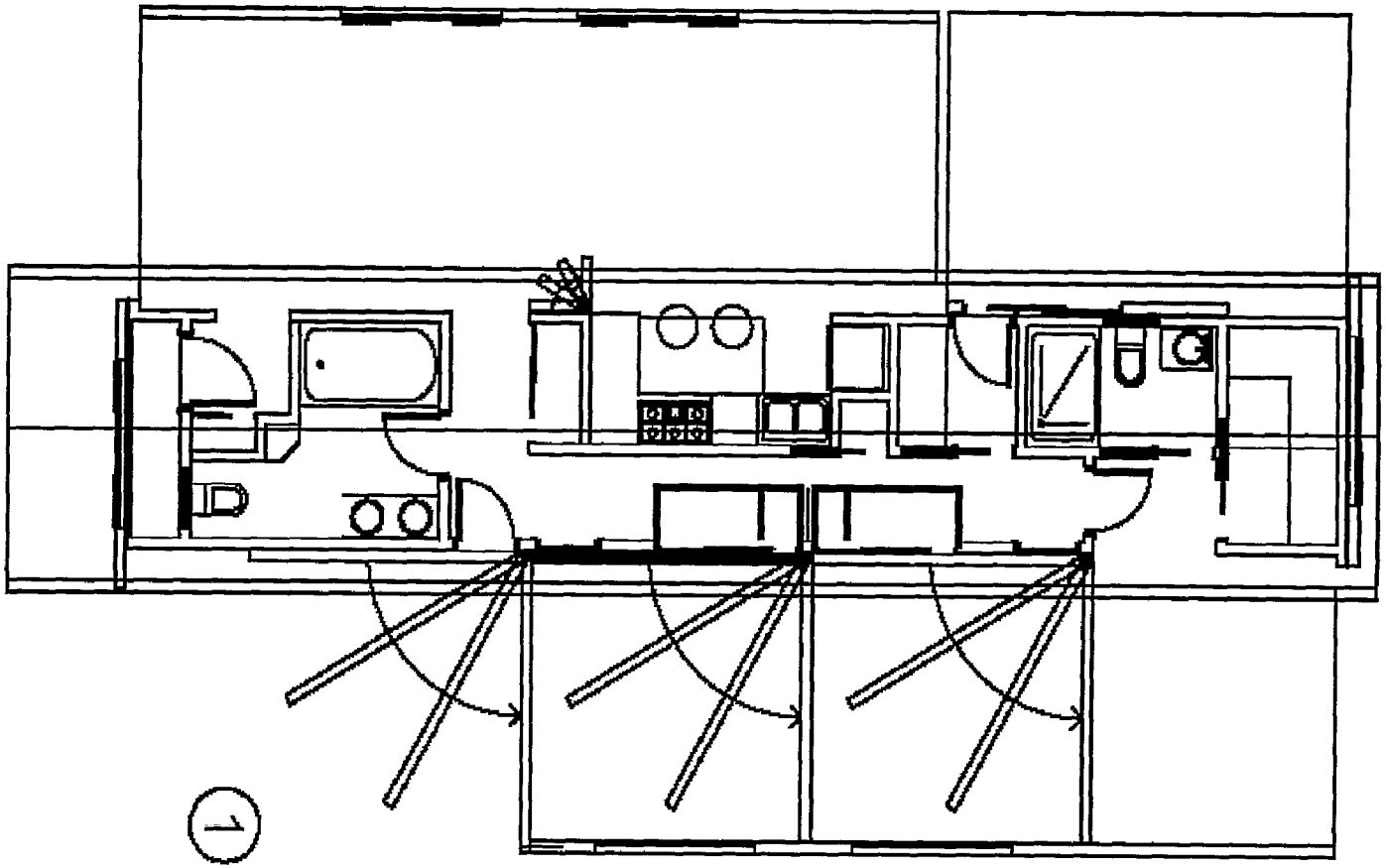
Figure 17D:
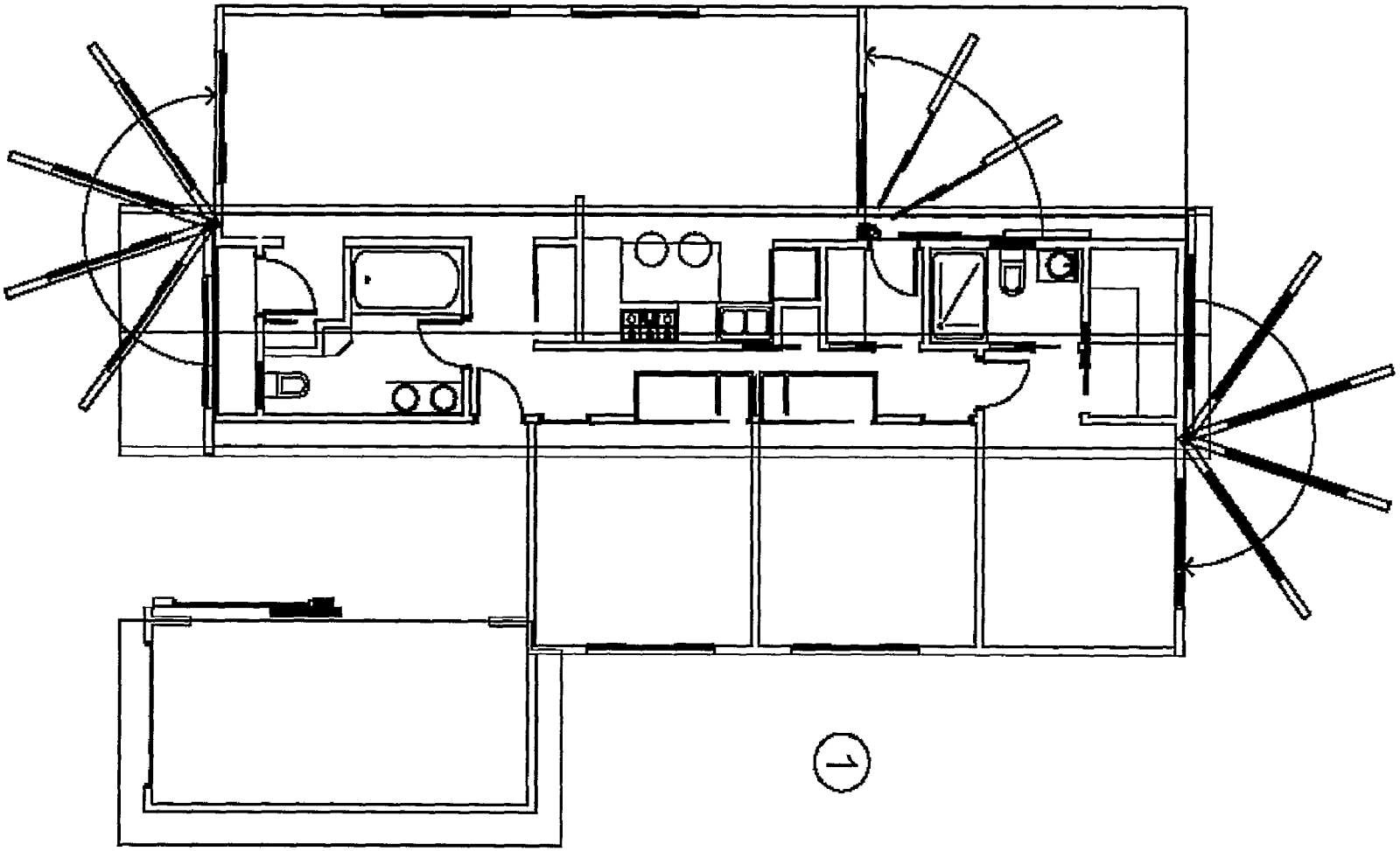
Figure 17E:
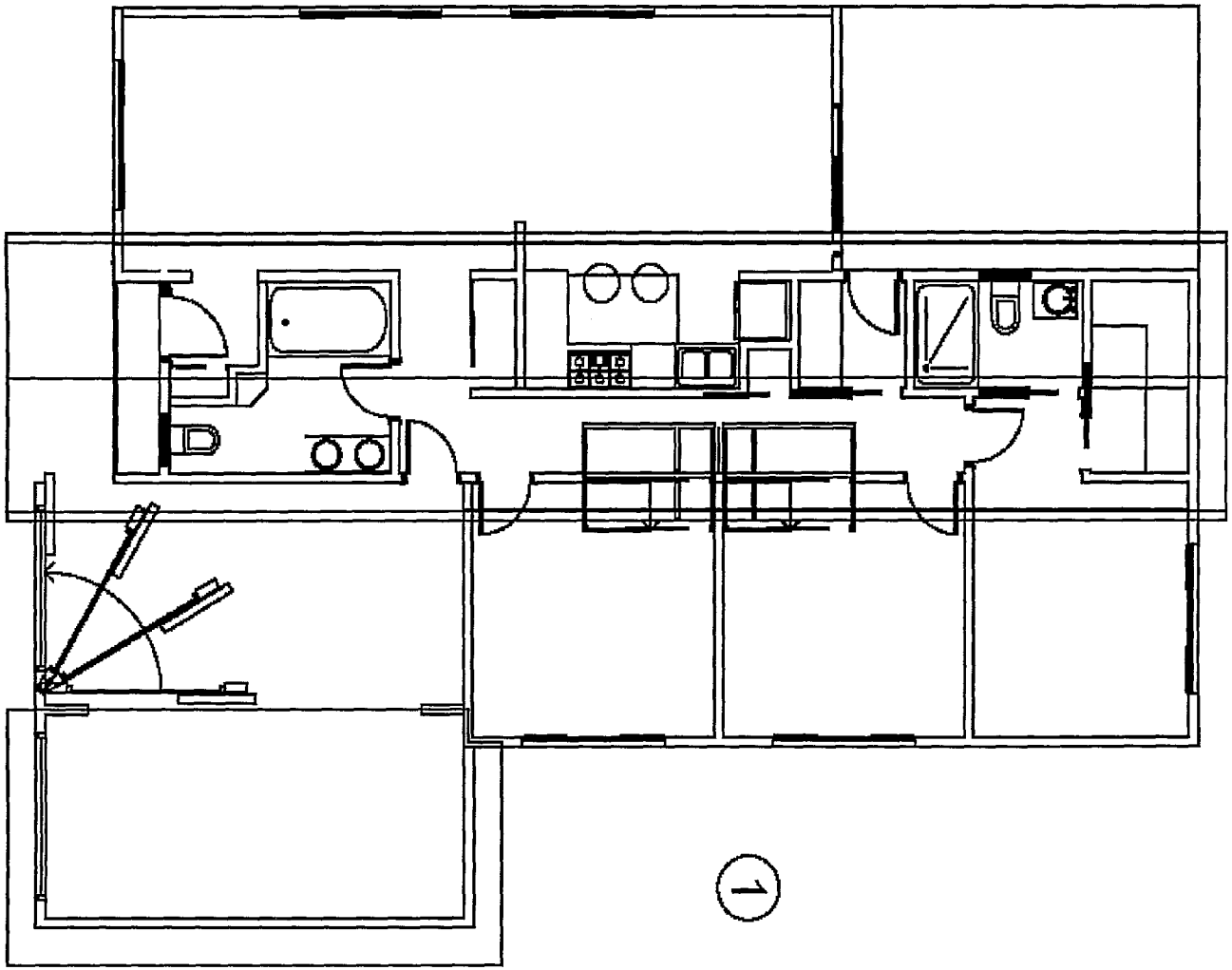
Figure 17F:
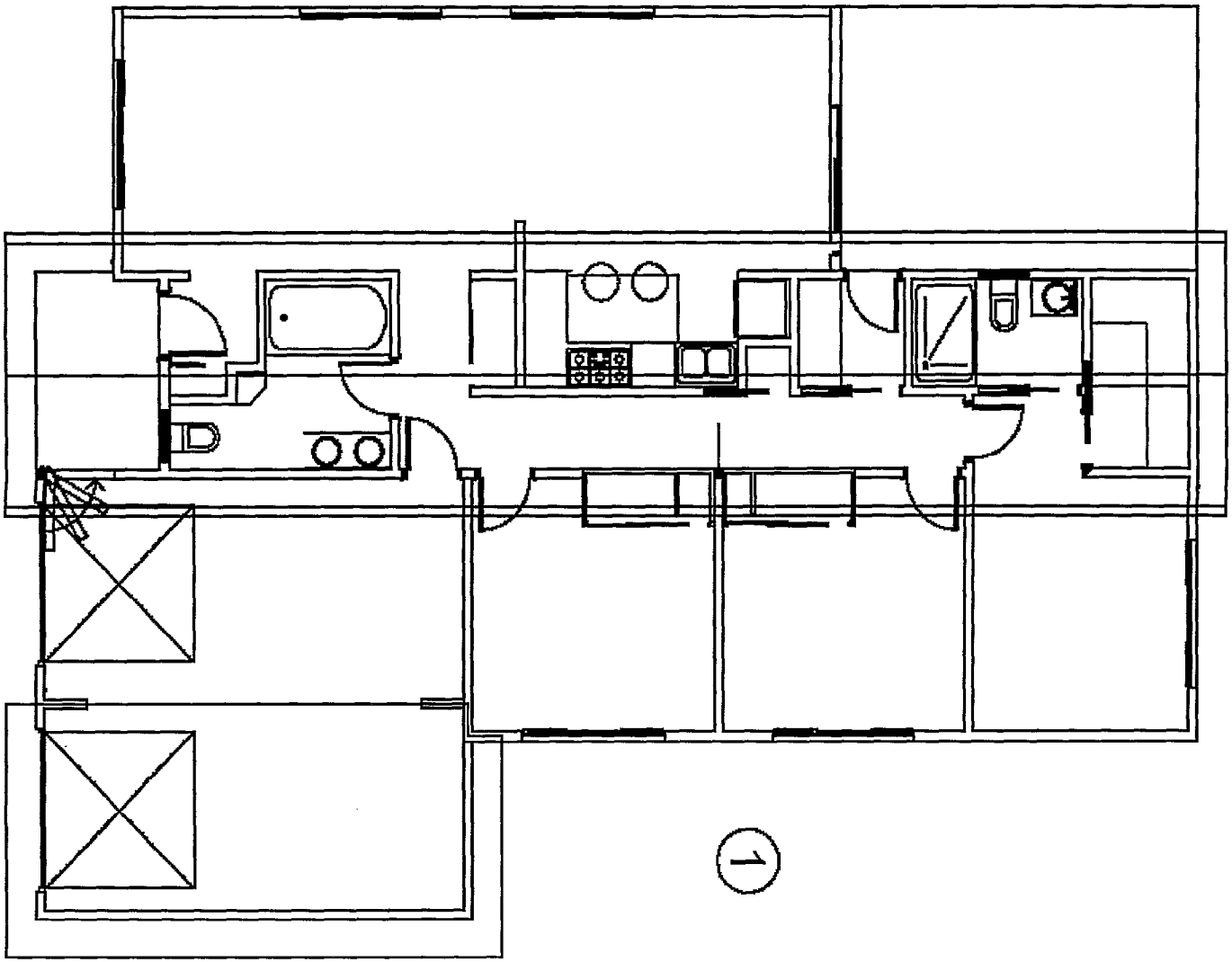
Figure 17G:
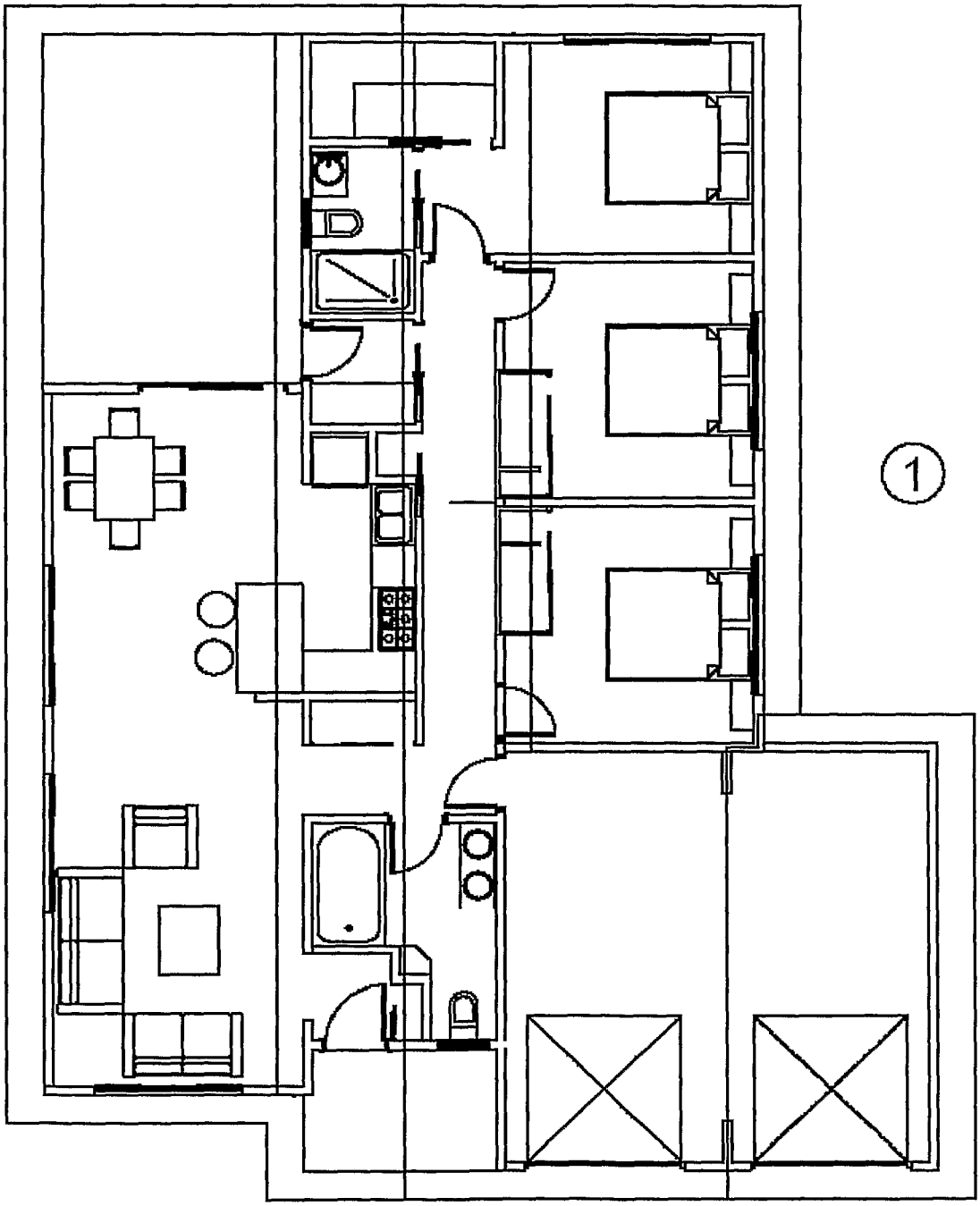

As best seen in FIGS. 15A and 15B, a connector in the form of a hinge 41 or the like is provided. The hinge 41 pivotally connects the second floor section 15 to the second wall 17. However, the hinge 41 can be utilised in a variety of areas about the enclosure 1 and should not be limited to this use only. The floor/wall hinge 41 includes a substantially U-shaped body 43 having a pair of flanges 45 with holes 47 to receive fastening means (not shown) to secure the flanges 45 to the second floor section 15. The body 43 also includes a pivot connection 49 or the like for pivotal mounting to the second wall 17 for example. The floor/wall hinge 41 is operable for angular movement about a generally horizontal axis between 0 to 90 degrees to pivot the floor section 15 relative to the wall 17. Advantageously, the floor/wall hinge 41 attaches two structures of the enclosure 1 together and can be located within a section 87. This provides folding at 90 degrees to a seamless join.

Figure 10:
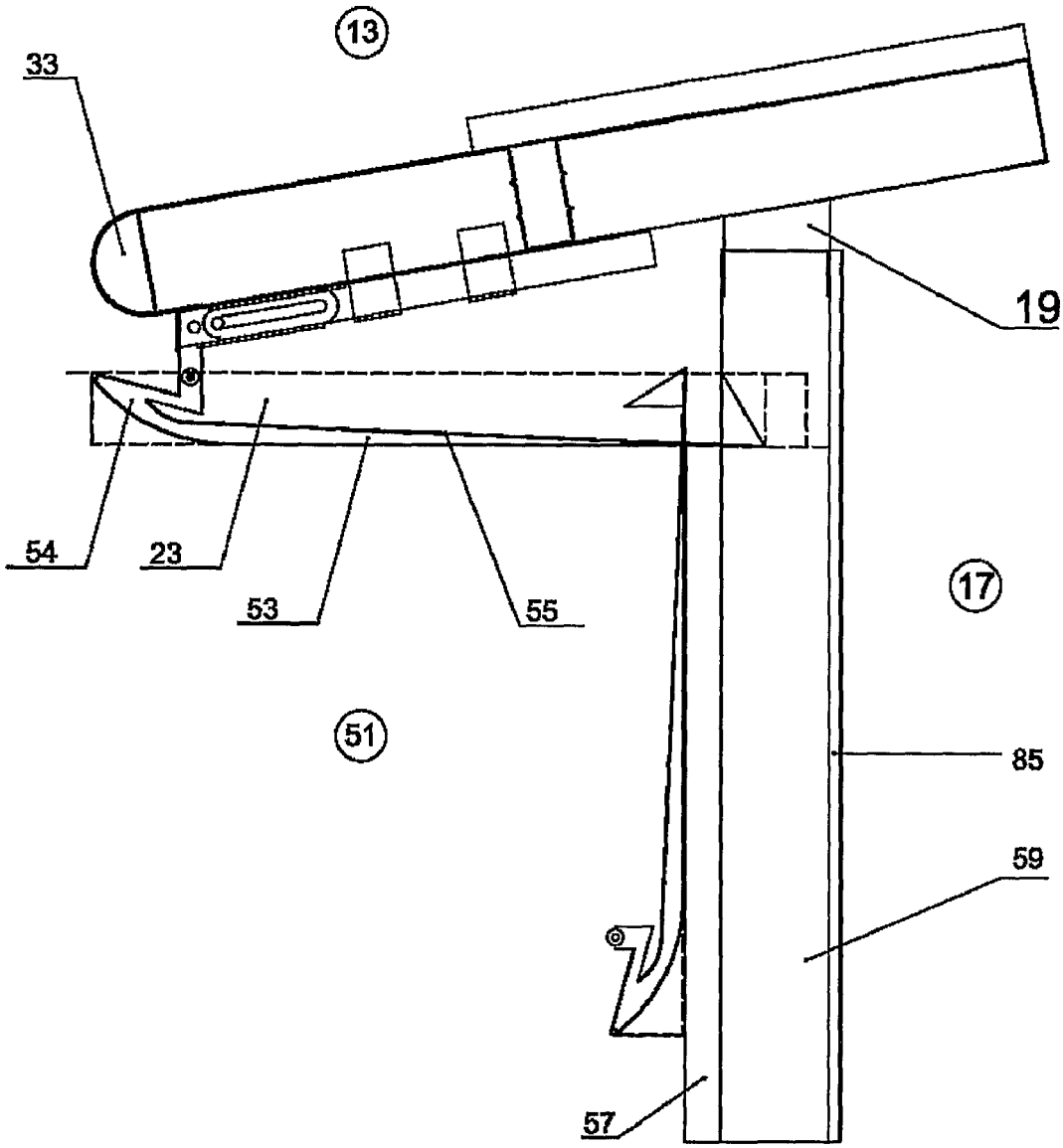
FIG. 10 shows a cutaway exploded side view of the gutter and eave system of the present invention.
Figure 23A:
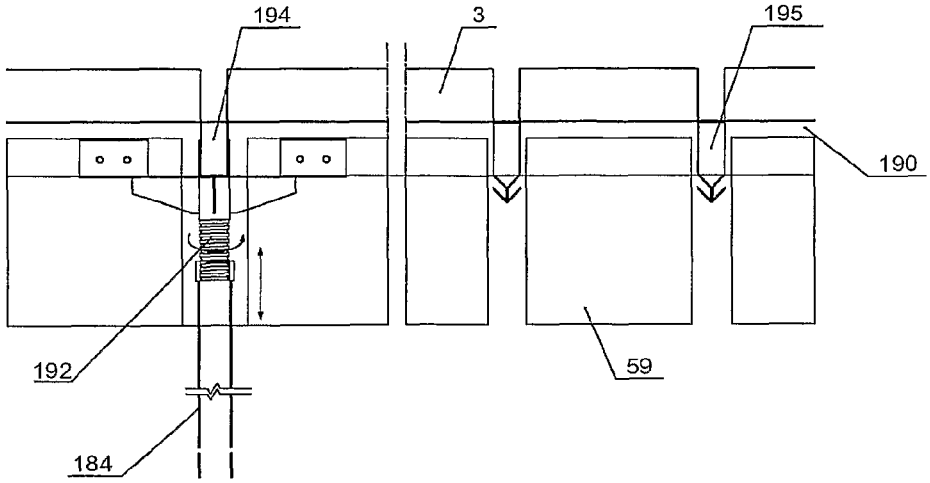
FIGS. 23A to 23E show the sub floor assembly for use with the present invention.
Figure 23B:
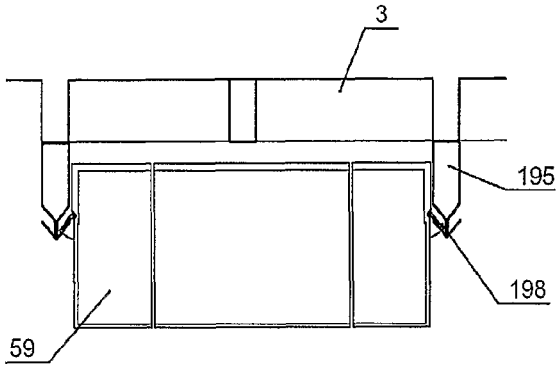
Figure 23C:
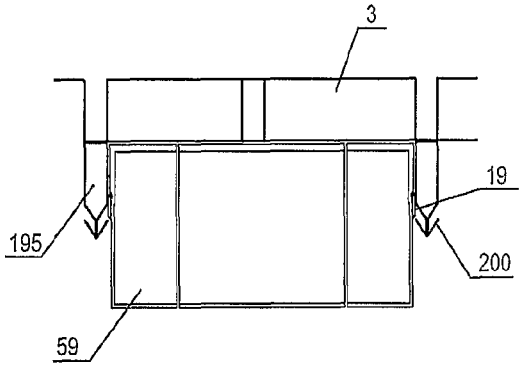
Figure 23D:
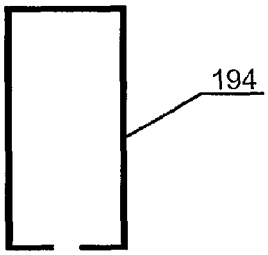
Figure 23E:
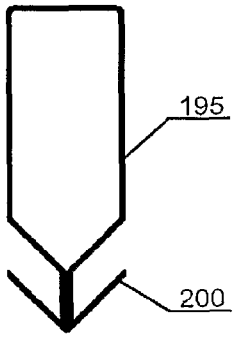
Figure 24A:
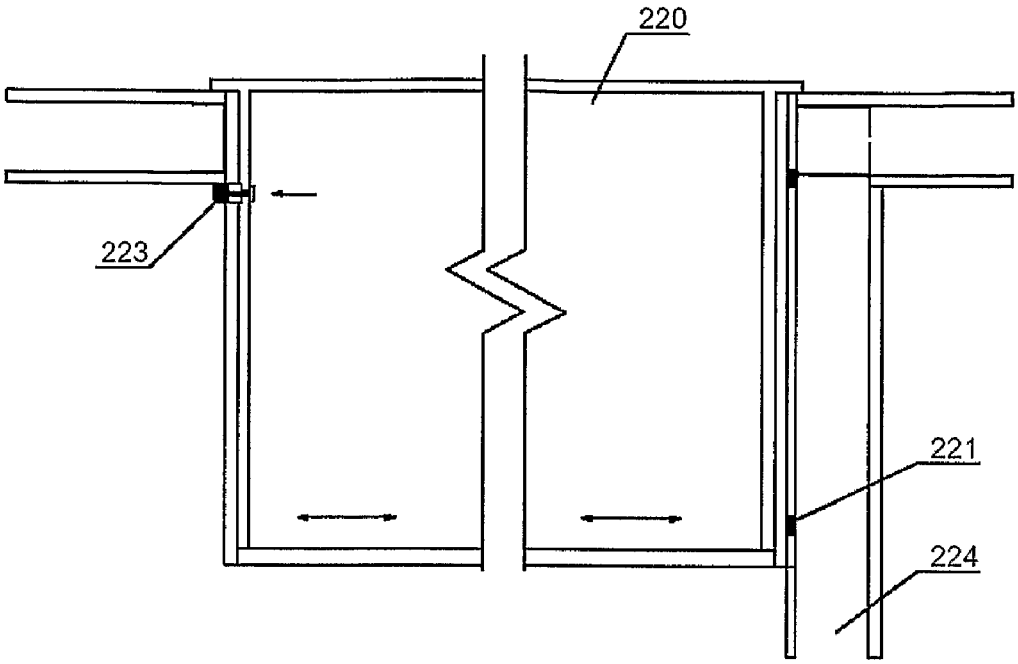
FIGS. 24A to 24D show a sliding mechanism for use with the present invention.
Figure 24B:
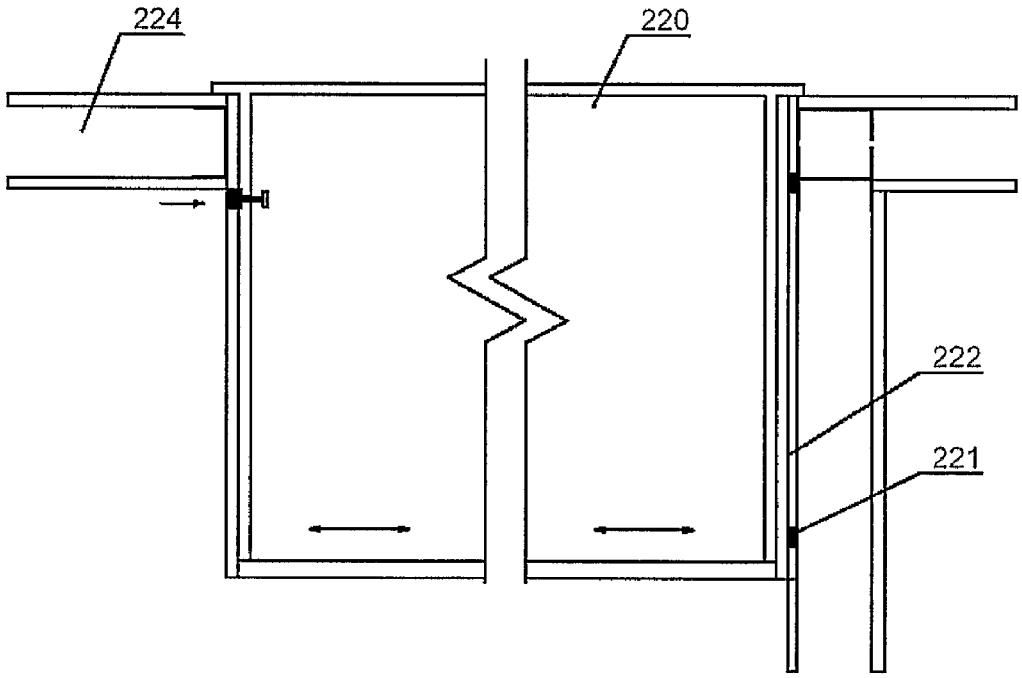
Figure 24C:
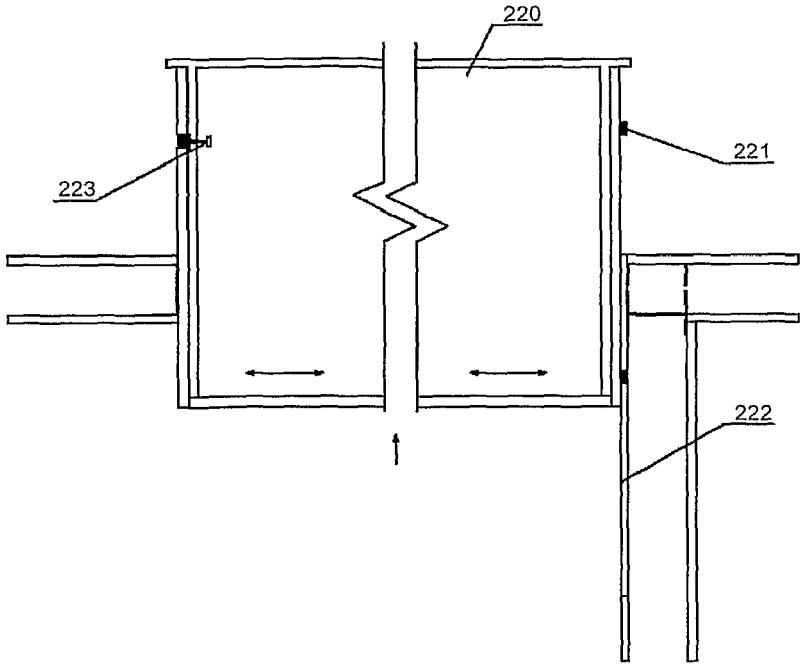
Figure 24D:
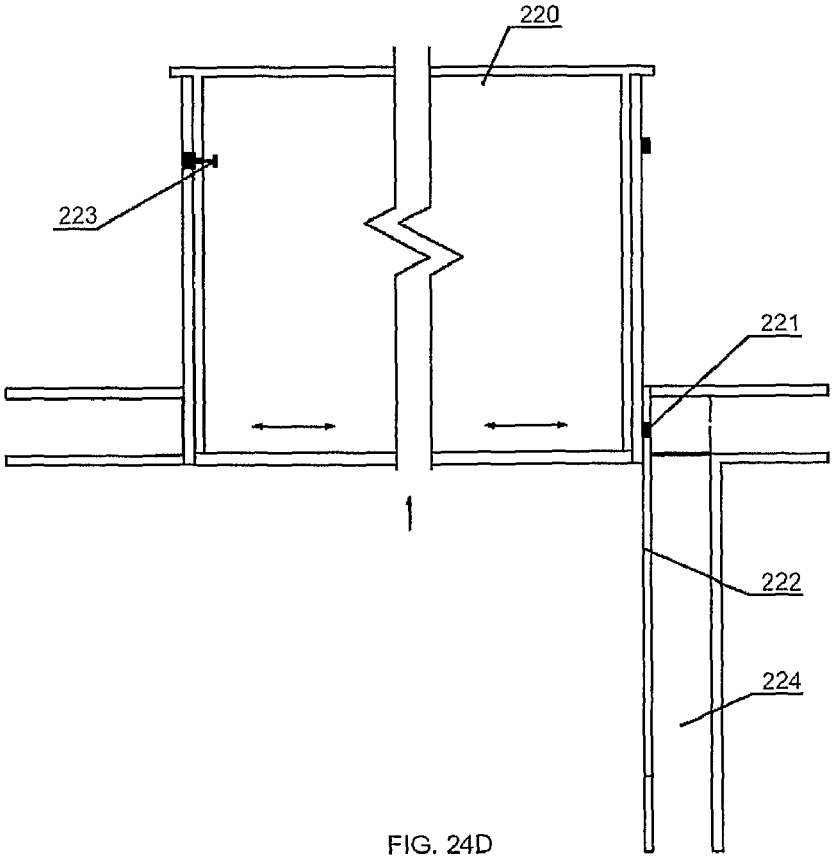

As best seen in FIG. 10, the second wall 17 includes an eave/gutter assembly 51 pivotally mounted to the second wall 17 for angular movement relative thereto about a generally horizontal axis. The eave/gutter assembly 51 includes means 53 to collect rainwater from the adjacent third roof portion 13. To assist in the rainwater runoff, the third roof portion 13 at the remote end 33 includes a substantially semi-circular end 33 to direct water into a convex shaped collector 54 on the means 53. The rainwater means 53 includes an elongate surface 55 tapered from the end 33 towards the second wall 17 to direct the captured rainwater towards the second wall 17. The second wall 17 can include a downwardly extending gutter 57, a reservoir 59 in fluid communication with the gutter 57 and/or the tapered surface 55. The reservoir 59 could be a water tank, bladder or the like. The reservoir 59 can be located external or internal of the wall 17 or above a ceiling or below a floor as shown in FIGS. 23A, 23B and 23C.

Figure 14A:
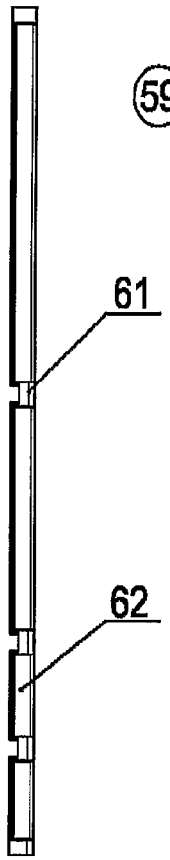
FIGS. 14A, 14B and 14C show water tanks for use in the present invention.
Figure 14C:
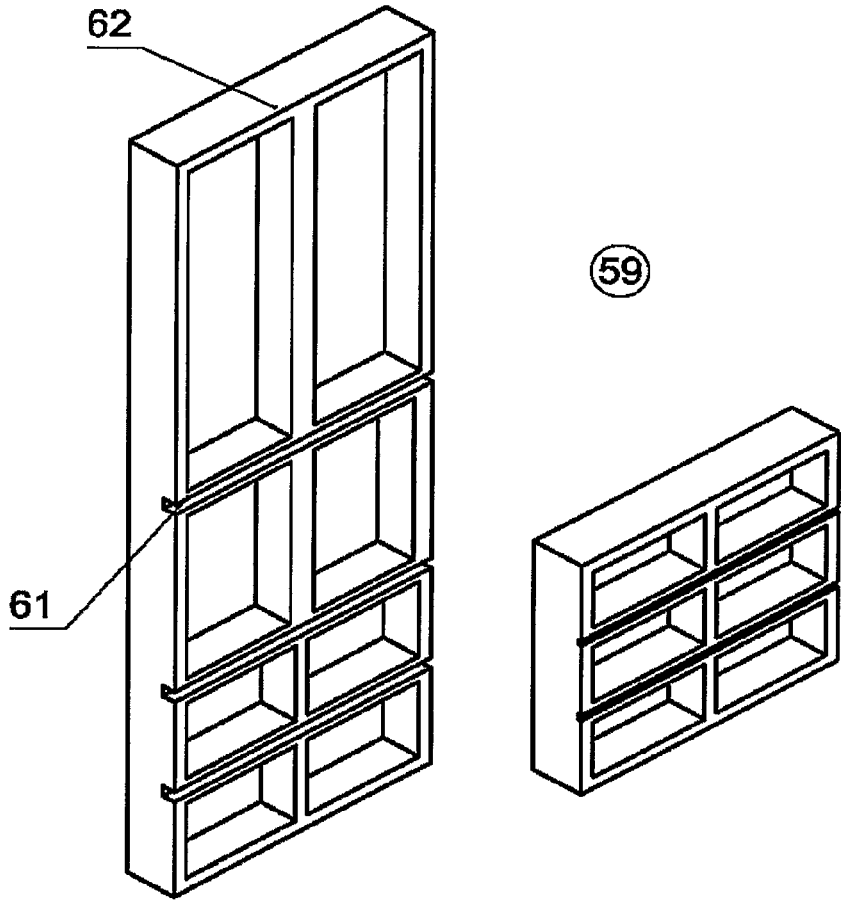
Figure 14B:
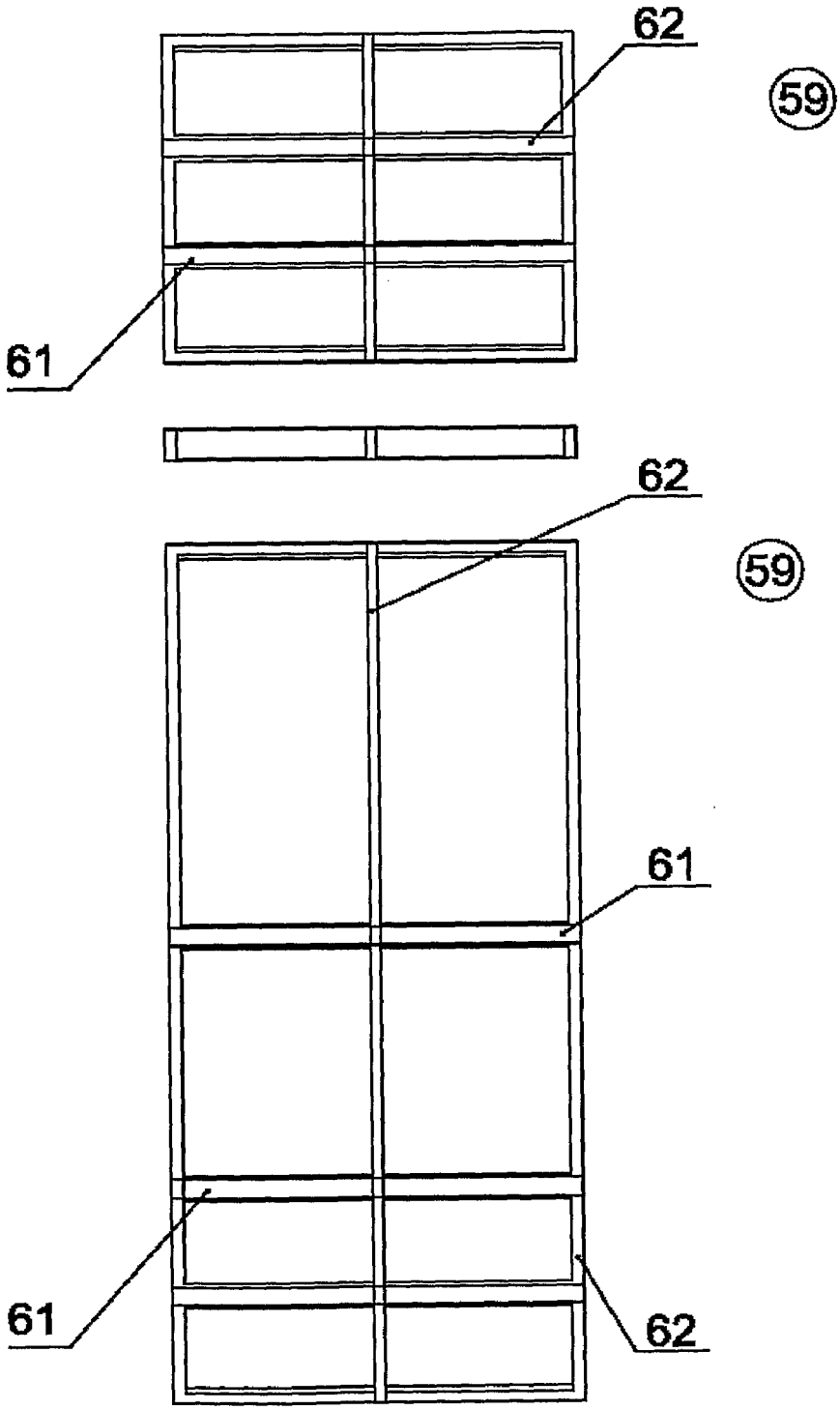

The reservoir 59 as best seen in FIGS. 14A to 14C includes longitudinally extending apertures 61 or the like to accommodate building services. The reservoirs 59 could also be utilised to provide additional structural support to the enclosure 1 and to assist in insulation and fire prevention for example. Fluids other than rainwater could be contained in a reservoir 59 such as waste water or grey water. The reservoir 59 includes members 62 that act as studs or the like to receive wall panels or the like. A release valve (not shown) could also be utilised to connect two or more reservoirs 59.

As shown in FIGS. 12A-12E the enclosure 1 further includes a hinge 63 for pivotally connecting the first and second roof portions 9, 11 and second and third roof portions 11, 13 for example. The hinge 63 however can be utilised in a variety of areas about the enclosure 1 and should not be limited to this use only. The roof hinge 63 includes a body 65 of a generally arcuate shape and includes substantially parallel and laterally spaced apart first and second faces 67, 69. Each face 67, 69 includes an arcuate slot 71 and a complimentary guide member 73 located within and for sliding movement along a respective slot 71. The guide members 73 being secured to the roof members 9, 11 and 13 for example. The roof hinge 63 is operable for angular movement about a generally horizontal axis between 0 and 180 degrees and creates a seamless join between the two structural elements it is connecting.

As shown in FIGS. 20A-F, a further connector or hinge 130 is located inside (that is it is not visible) a wall, floor or roof section 87. The connector 130 which enables the wall, floor, (or any other two members) to be connected. The hinge 130 is located within the section 87 and includes a generally Y shaped member 132 pivotable about a point 133 and includes two arms 134, 135 defining a recess 136 therebetween. One arm 135 extends towards a ratchet 137 and is movable therealong to limit rotation of the member 132 about the pivot point 133. The ratchet 137 also rotates about a pivot point. A piston mechanism 138 or the like can be utilised to urge the member 132 or ratchet 137 to either lock or unlock each other and thereby the connector 130. The piston 139 can include rods 146 and springs 147 or the like. A further arm 140 is fixed to and extends from an adjacent section 87 through an aperture 142 and includes a portion 141 to be received within the recess 136 of the member 132. An end 145 pushes the member 132 about its pivot axis and along the ratchet 137. The connector 130 is able to fold with overlapping material such as roof, corrugated iron external cladding without the need to repair or patch the folding joint.

Figure 13A:
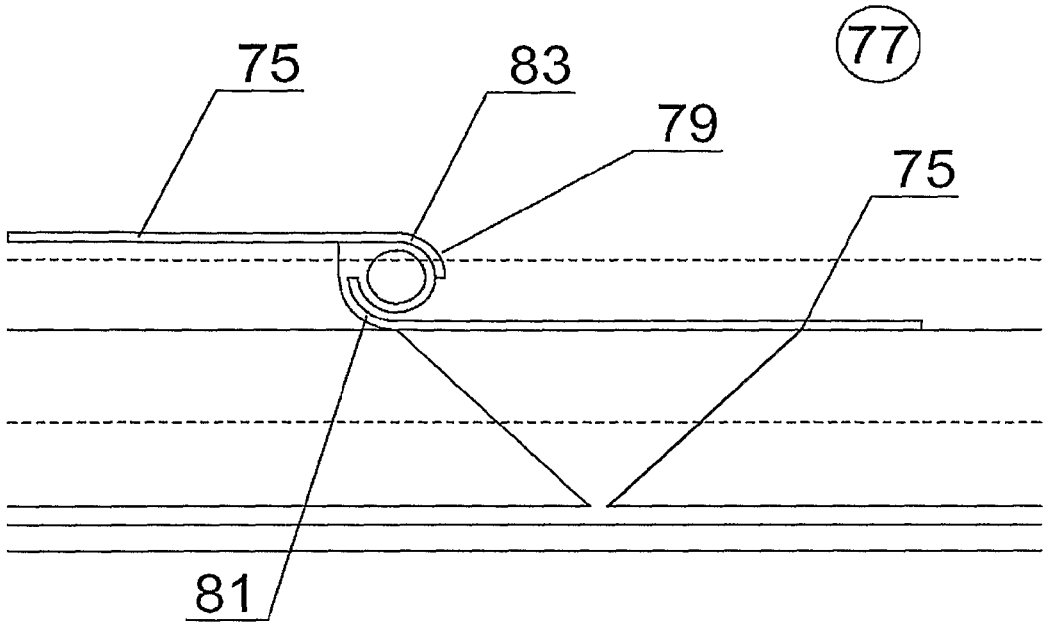
FIGS. 13A and 13B show a sheet connector and roof sheets for use in the present invention.
Figure 13B:
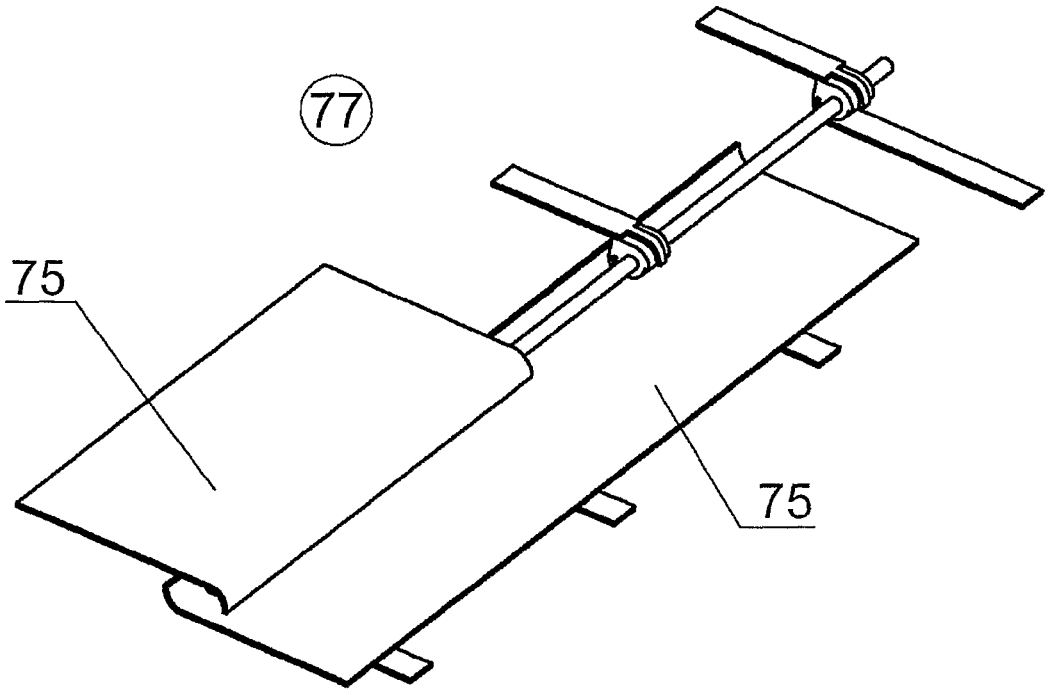
Figure 13C:
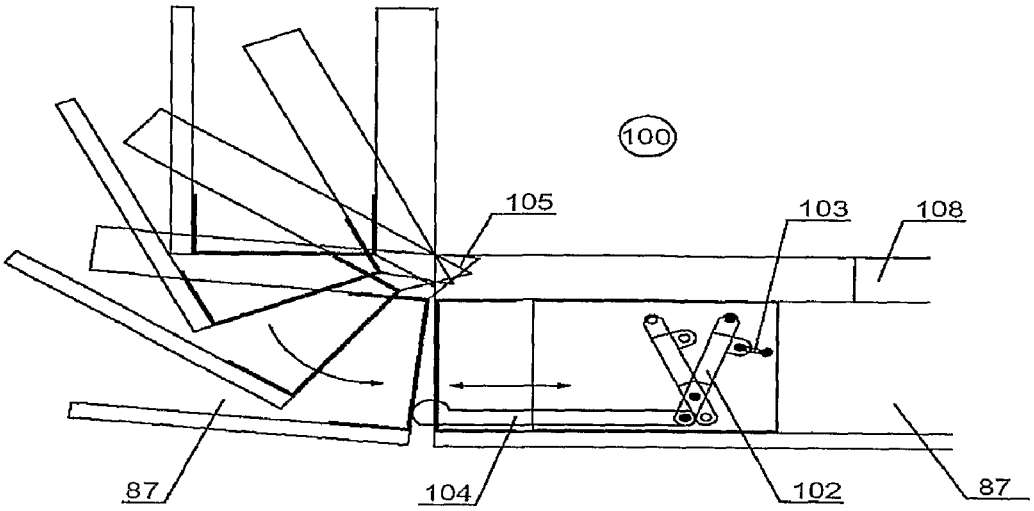
FIGS. 13C to 13H show an alternative sheet/roof connector for use in the present invention.
Figure 13D:
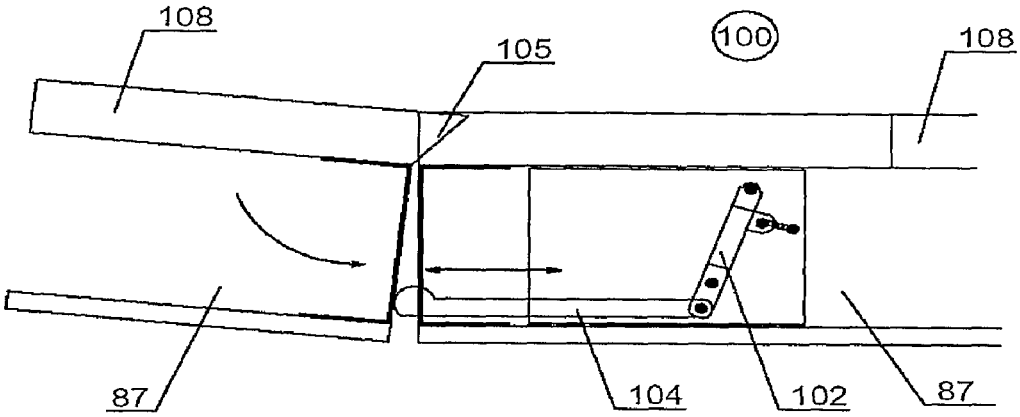
Figure 13E:
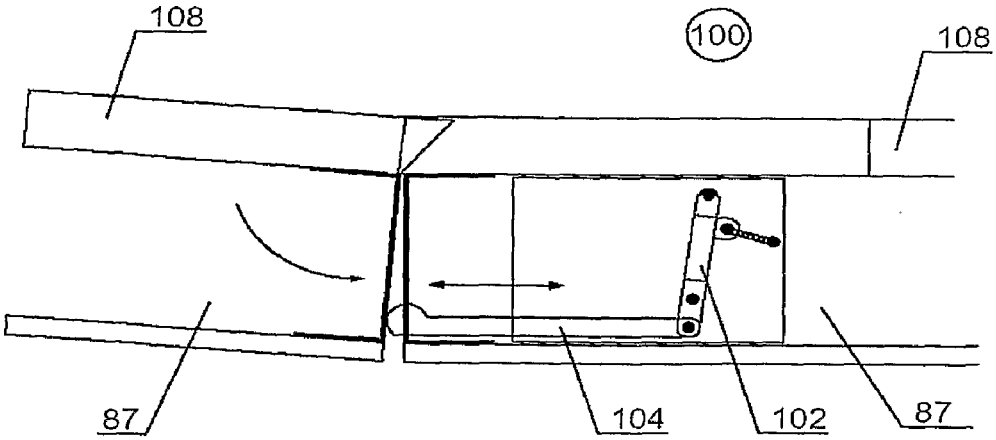
Figure 13F:
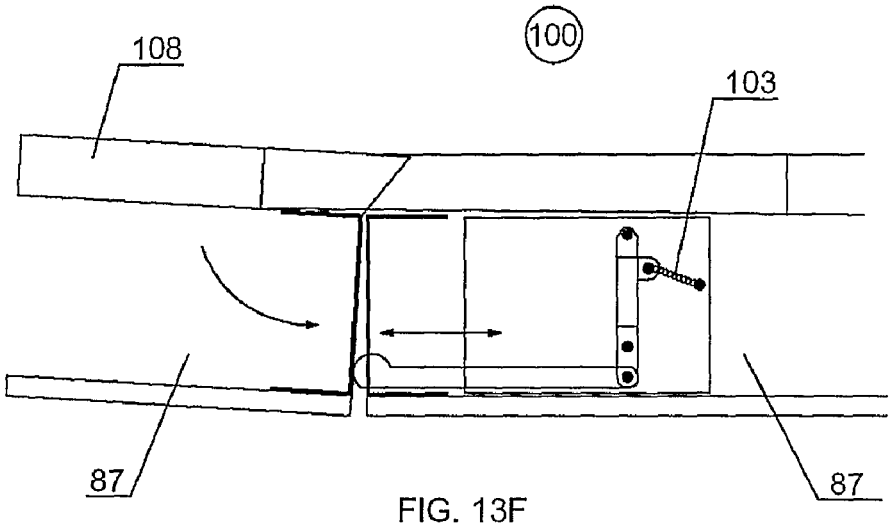
Figure 13G:
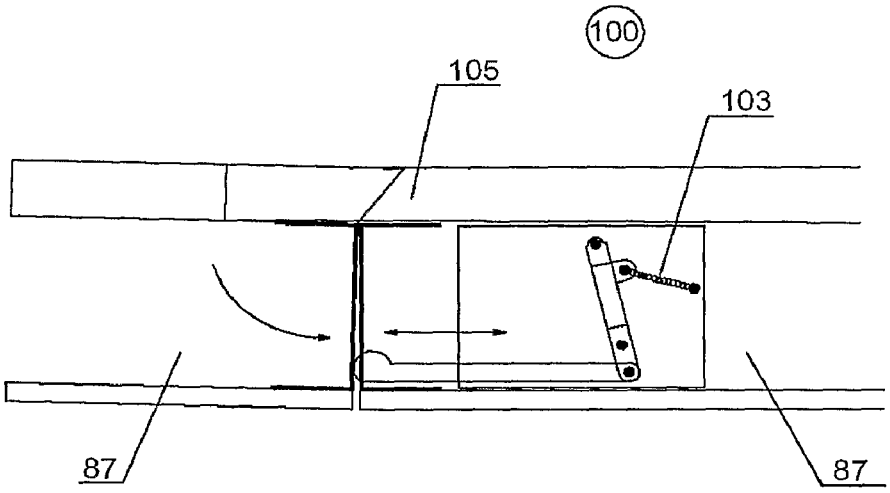
Figure 13H:
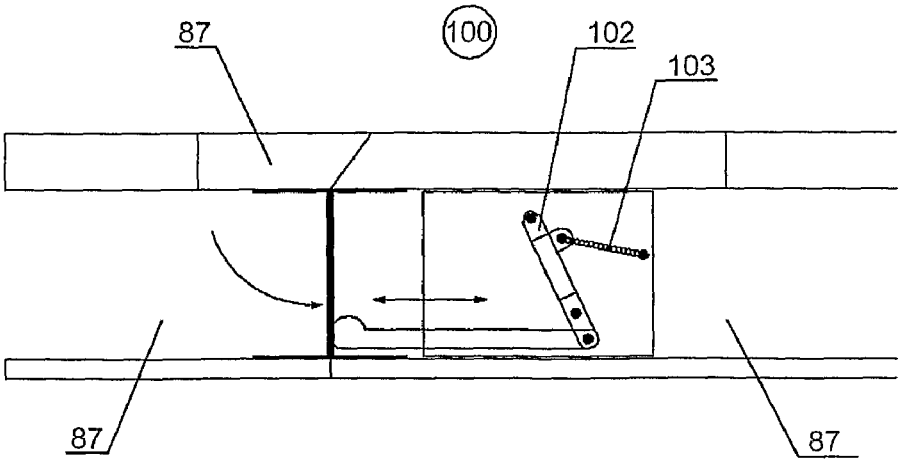

As shown in FIGS. 13A, 13B the roof portions 9, 11 and 13 can include a plurality of roofing sheets 75. A connector or hinge 77 connects the adjacent roof sheets 75 and is operable for angular movement about a generally horizontal axis. The sheet hinge 77 includes a substantially circular longitudinally extending body 79 having a substantially circular slot 81. An end 83 of an adjacent sheet 75 being locatable within the slot 81 for angular movement relative thereto.

As shown in FIGS. 13C to 13H a further connector assembly 100 is shown. The connector assembly 100 is primarily used to connect roof portions 9, 11, 13 and is an alternate connector to the one shown in FIGS. 13A and 13B. The connector 100 is located within a supporting structure such as section 87 and includes a member 102 moveable between a retracted and extended position and a spring 103. The member 102 is connected to a pivot on the section 87. The spring 103 is connected at one end of the member 102 and a bar 104 is connected at the other end. The bar 104 extends longitudinally of the section 87 to urge the adjacent section 87 in a transverse direction form the bar 104. This movement allows for the adjacent roof portion and section 87 to slide a connecting piece 105 between adjacent roof portions 108 allowing the two roof portions 108 to be connected seamlessly creating a waterproof membrane. The connector 100 like all the alternate connectors/hinges of the enclosure 1 can be operated by mechanical, hydraulic or electrical means (not shown).

As best seen in FIGS. 16A to 16E, the enclosure 1 includes structural sections 87 which include at least one transverse channel 89 for receiving a corresponding section 87 to form a generally T-shaped connection. The section 87 also includes at least one rib 91 extending along the longitudinal length of the section 87. The section 87 has a base 93, upwardly extending walls 95 and outwardly extending flanges 97. A strengthening or supporting block 96 can be placed inside the section 87 to provide joint strength and rigidity to the enclosure 1. The block 96 can have a channel 94. The block 96 in the preferred form would be manufactured from plastic however could be manufactured of any suitable material and the section 87 would preferably be a steel section. In this way, one single profiled section 87 can be used for walls, roofs and floors and provide a structural frame for the enclosure 1.

Figure 18A:
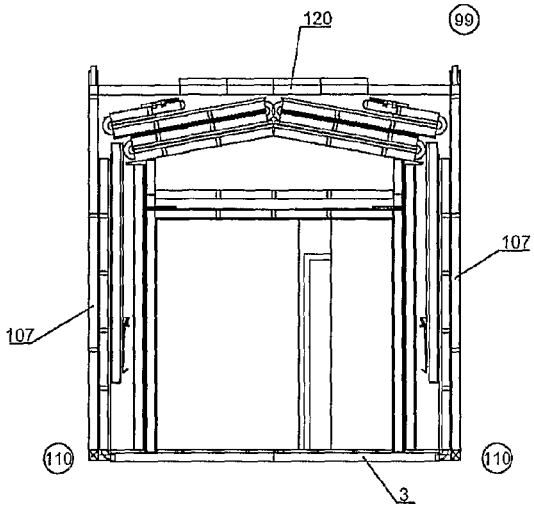
FIGS. 18A to 18C show a container for use with the present invention.
Figure 18B:
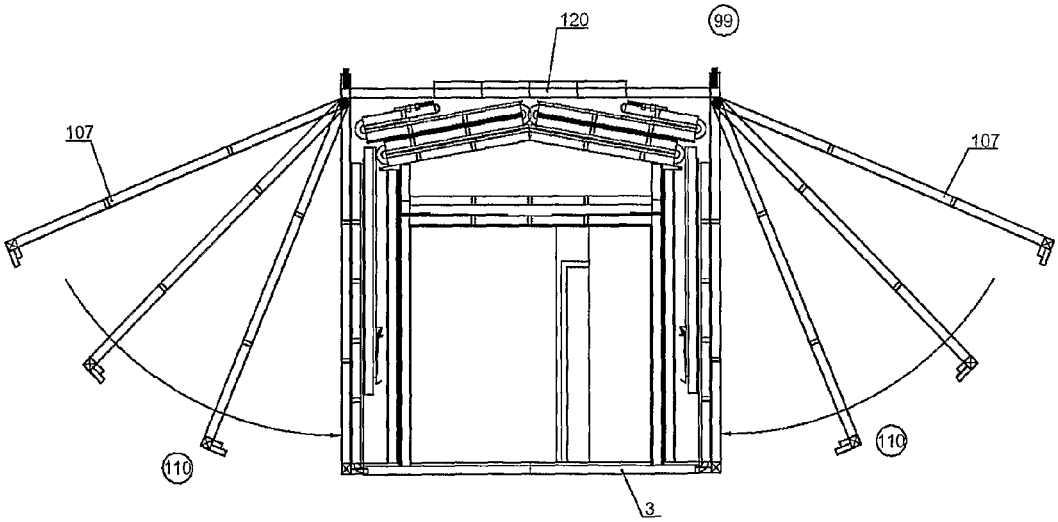
Figure 18C:
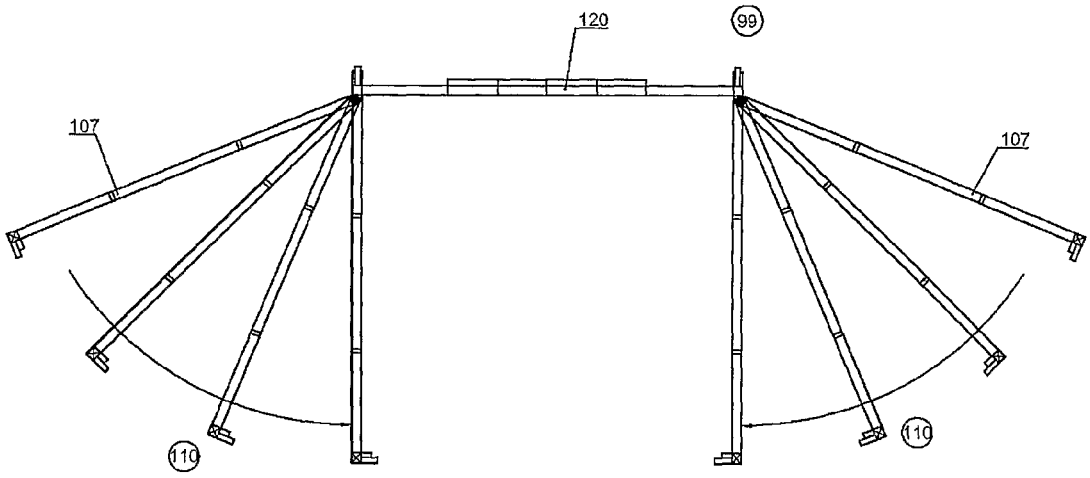

As seen in FIGS. 1 to 9 and 18A to 18C, the enclosure 1 can include a container 99 to transport the enclosure 1 to a destination site. The first floor section 3 of the enclosure 1 can form the floor of the container 99. In a preferred form, the enclosure 1 is to be a dwelling or house and accordingly as seen in the figures a number of enclosures 1 can be connected together to form a much larger enclosure such as a house or building (see FIGS. 17A to 17G). The container 99 can be lowered, onto pre-established jacks/stands which act as foundations or footings for the enclosure 1. The shell of the container 99 is withdrawn leaving the enclosure 1 sitting on the jacks/stands. As shown in FIGS. 18A to 18C, the walls 107 of the container 99 are pivotable with respect to the top web 120 to allow the walls 108 and web 120 to be substantially parallel in a folded configuration or provide a "flat pack". The empty folded container 99 (5 or 3 sides) is returned to the point of manufacture "flat packed" and refilled with another enclosure 1. The container 99 can also include various standard features such as hooking and mounting plates to allow the container 99 to be moved like an ordinary container.

Figure 19A:
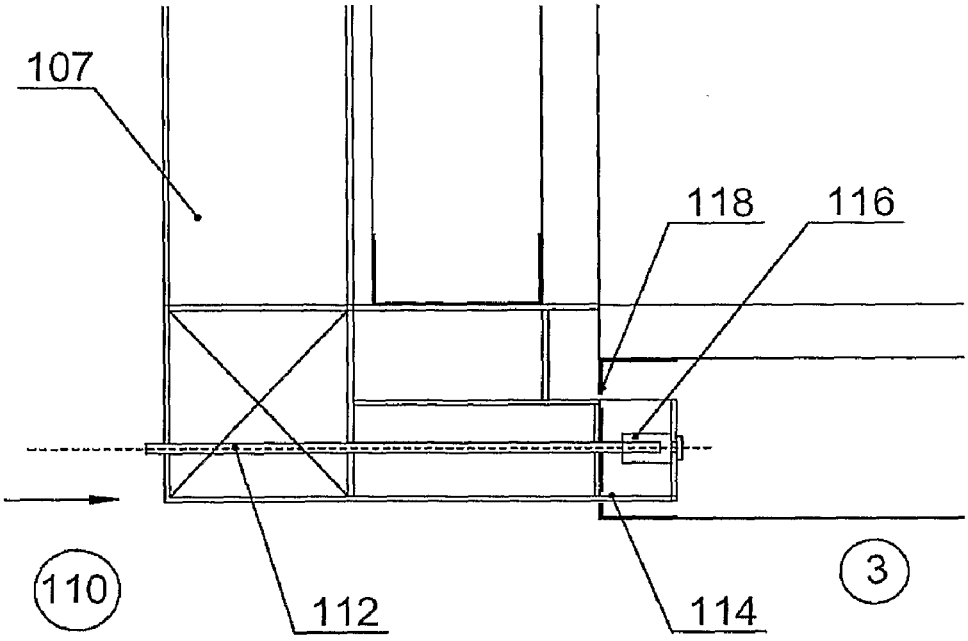
FIGS. 19A and 19B show a further connector for use with the container and enclosure of the present invention.
Figure 19B:
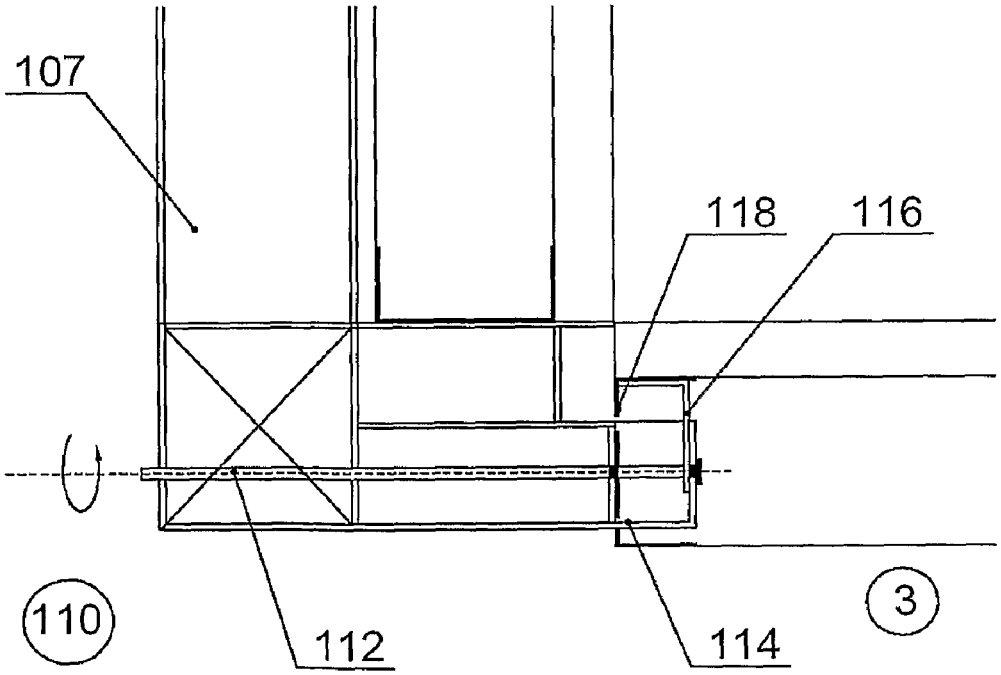
Figure 20A:
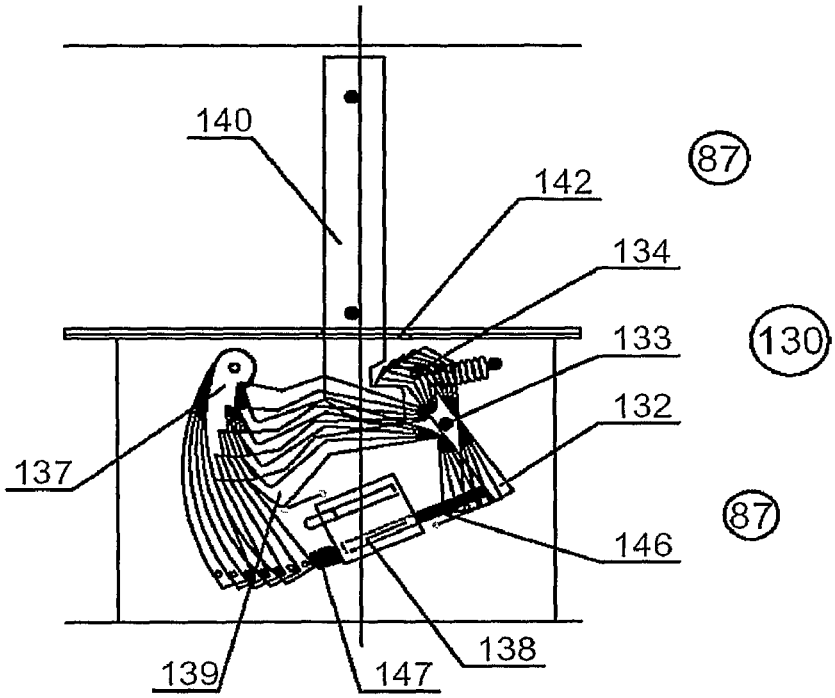
FIGS. 20A to 20F show a further connector for use in the present invention.
Figure 20B:
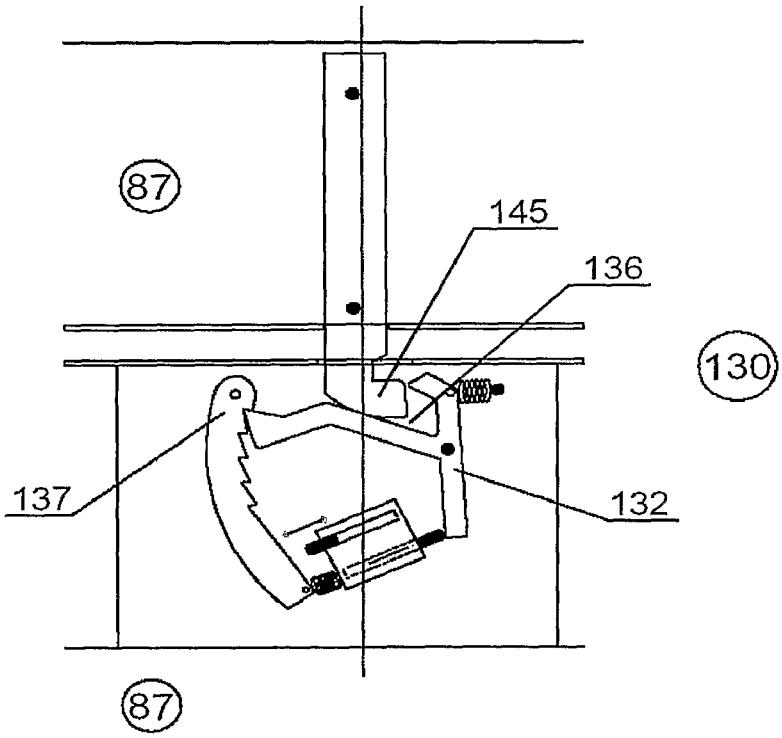
Figure 20C:
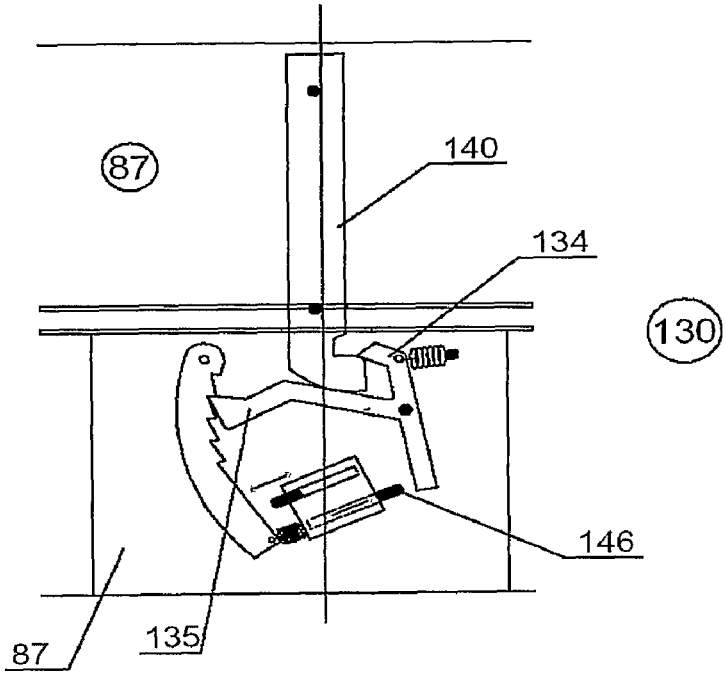
Figure 20D:
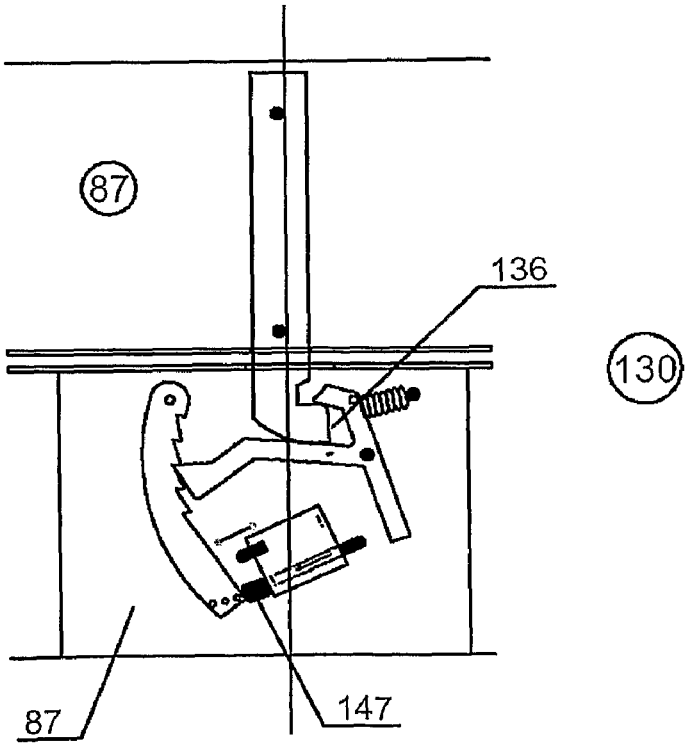
Figure 20E:
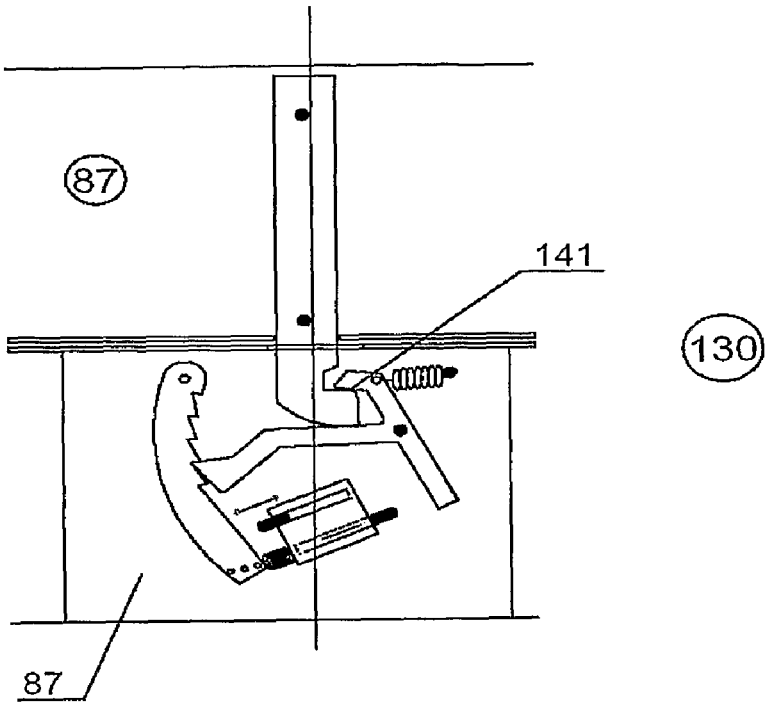
Figure 20F:
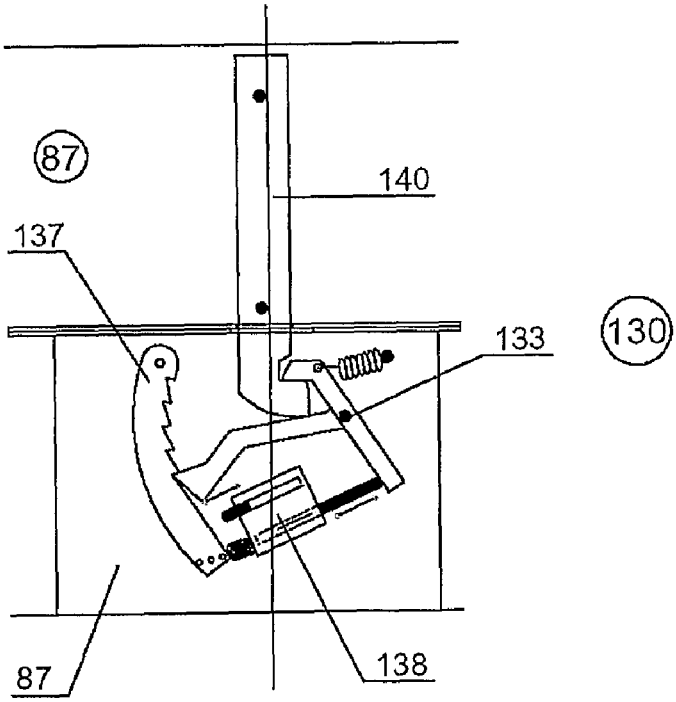

As shown in FIGS. 19A and 19B, the walls 107 of the container 99 include a further connector 110 to secure the walls 107 to the floor section 3 of the enclosure 1. the connector 110 can be of any type however in the preferred embodiment, a pin, rod or the like 112 extends from the wall 107 and is locatable within an aperture 114 in the floor section 3. The pin 112 once located in the floor section 3 can be rotated to activate a latch 116 located at the end of the pin 112. The latch 116 locks onto an internal flange 118 of the floor section 3 locking the wall 107 and the floor section 3 together. The latch 116 can include a ratchet, spring, clip or the like to assist with the connecting and can also include a manual, hydraulic or electronic release (not shown). The connector 110 eliminates the need for screws or bolts. Further, the connector 110 is hidden within the structural elements of the enclosure 1 and won't be seen. This connector 110 could also be used to secure other parts of the enclosure 1 together and should not be limited to the above described use. The container 99 therefore includes a locking system that provides container security when the contents (being the enclosure 1) are placed inside the container 99. The container 99 is operated via hydraulic lifting shafts to unfold and fold the container 99. As the enclosure 1 can be of any size the container 99 must also be of varying sizes and could use sectionalised panels or the like to vary the length of the container 99 to accommodate various enclosure sizes.

Figure 21A:
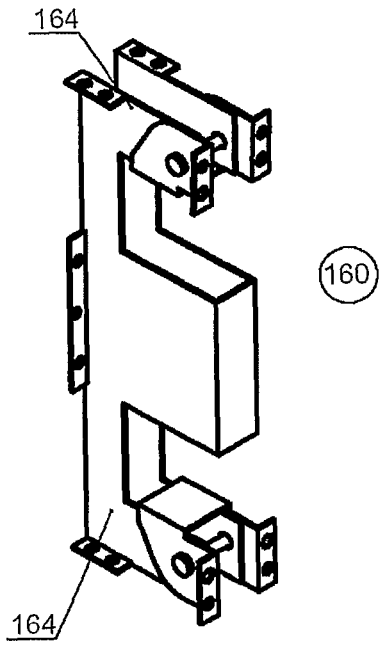
FIGS. 21A to 21F show a further container for use in the present invention.
Figure 21B:
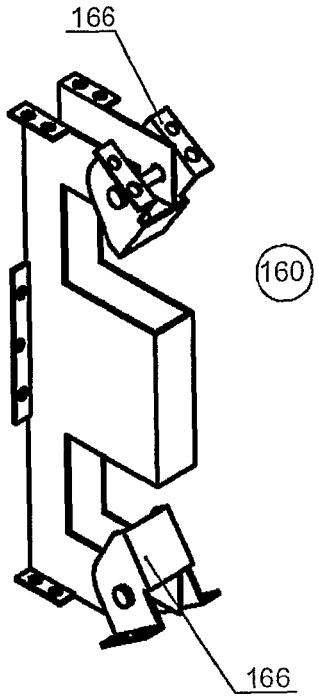
Figure 21C:
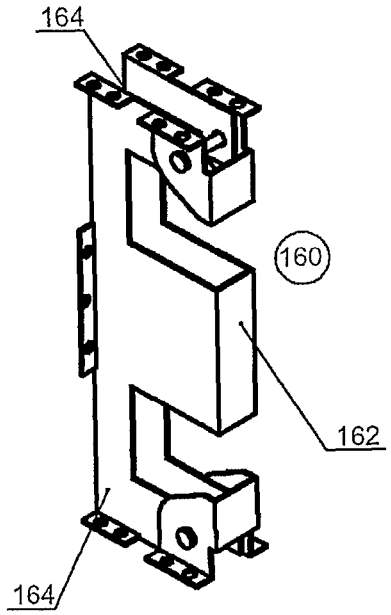
Figure 21D:
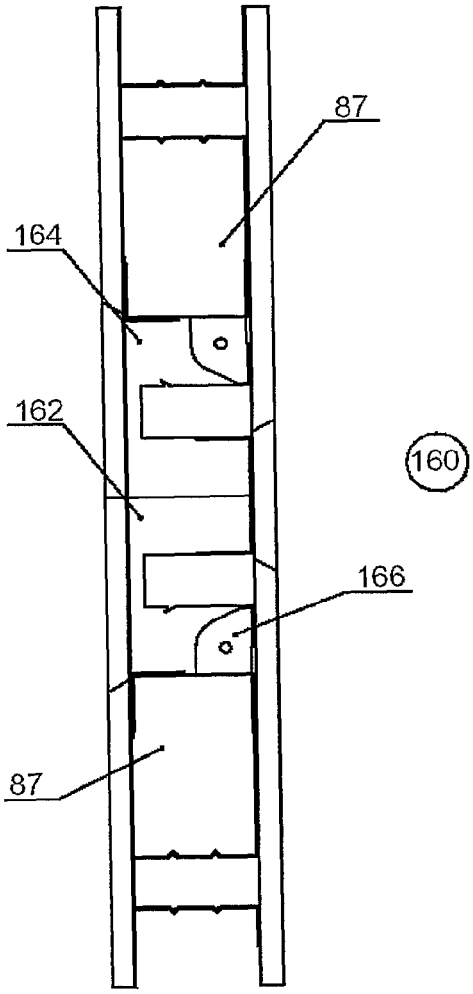
Figure 21E:
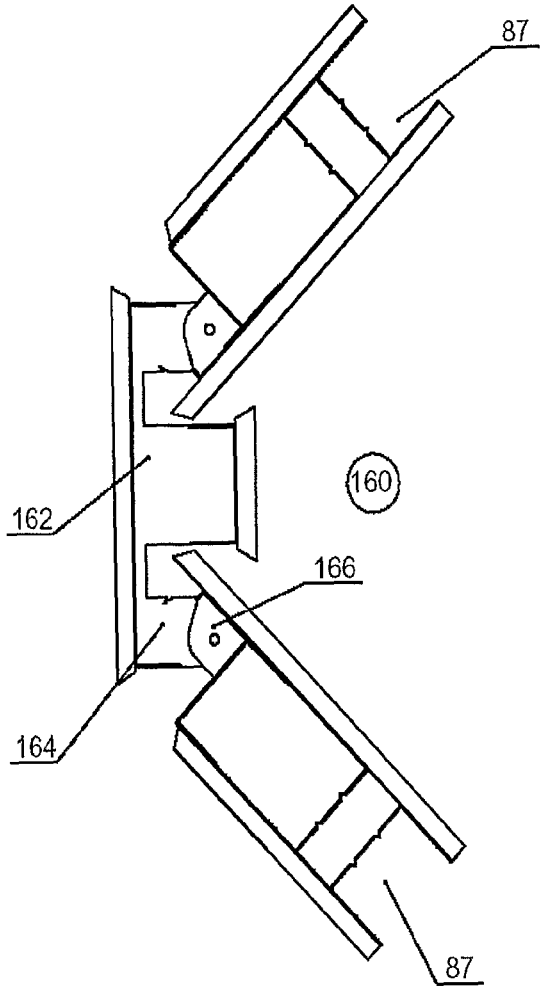
Figure 21F:
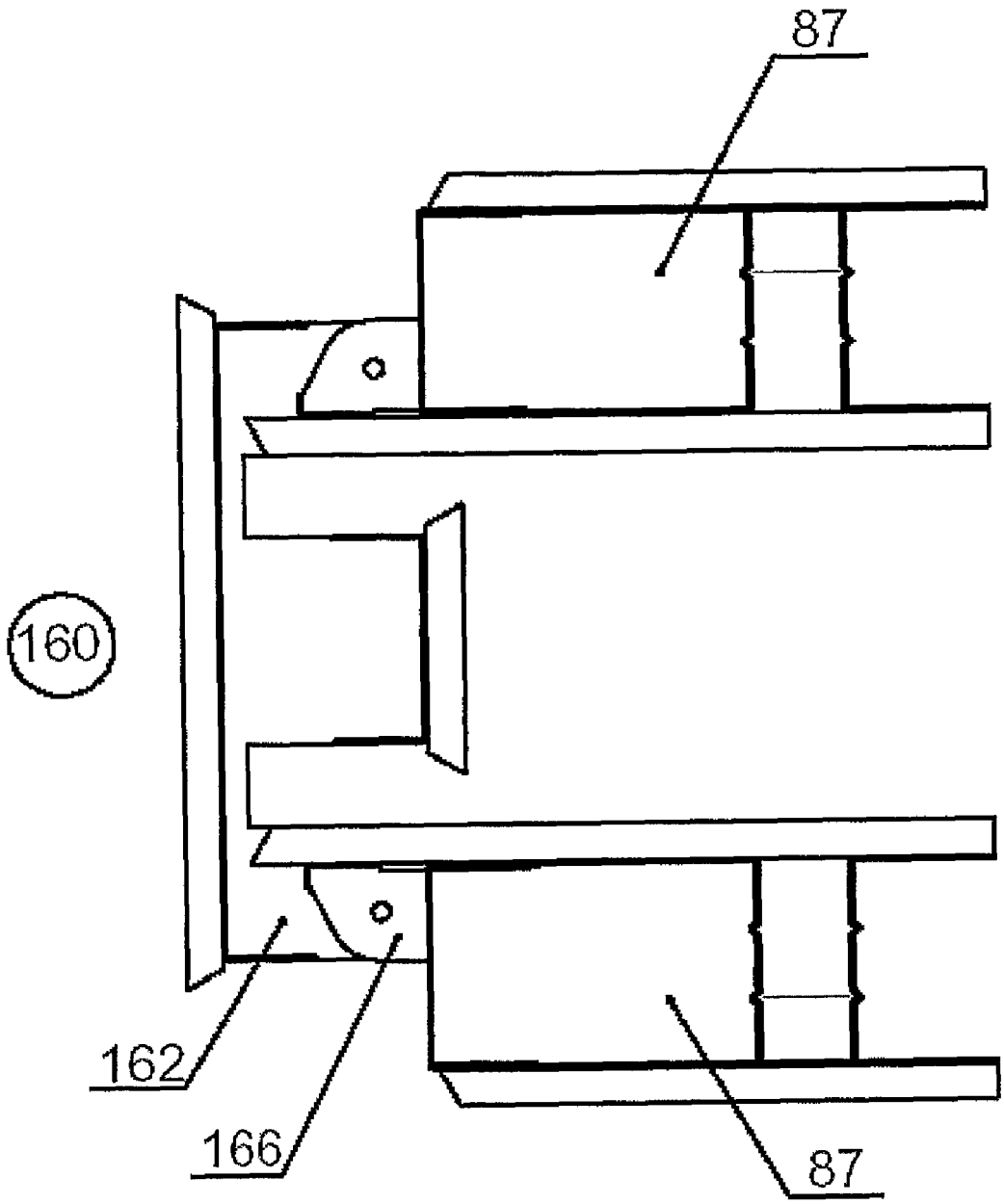
Figure 22A:
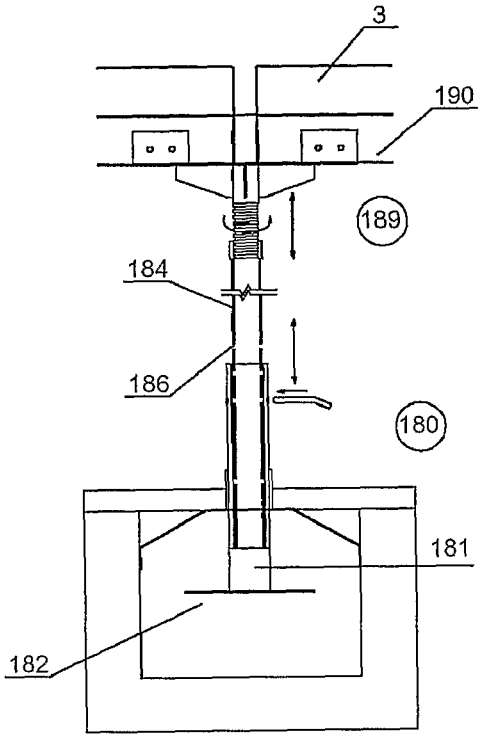
FIGS. 22A to 22D show footings and jacks for use with the present invention.
Figure 22B:
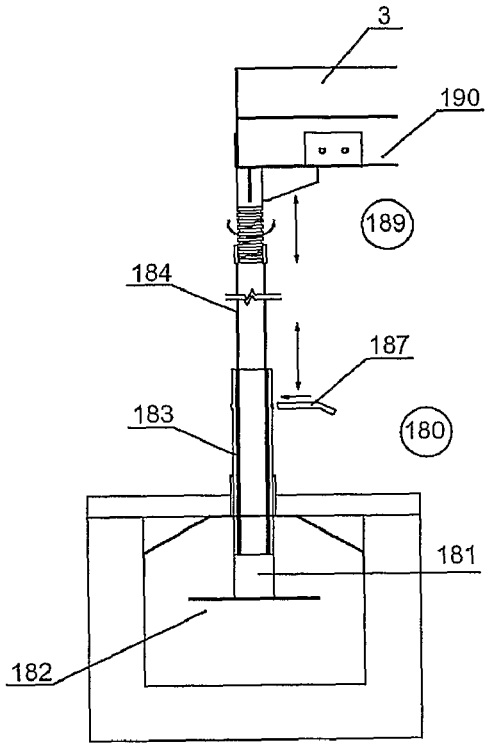
Figure 22C:
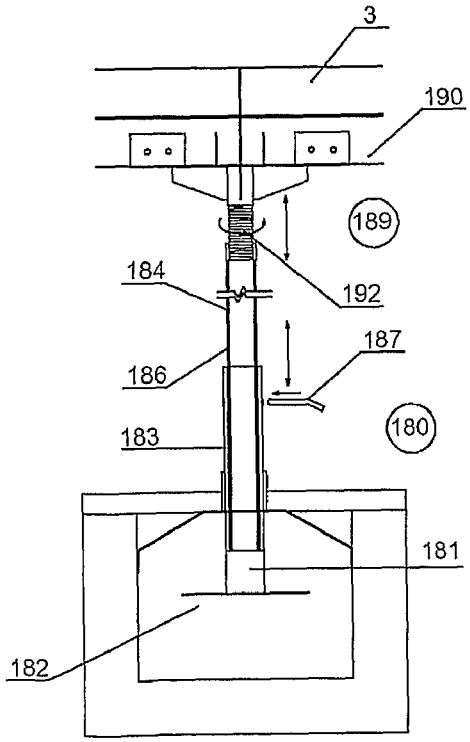
Figure 22D:
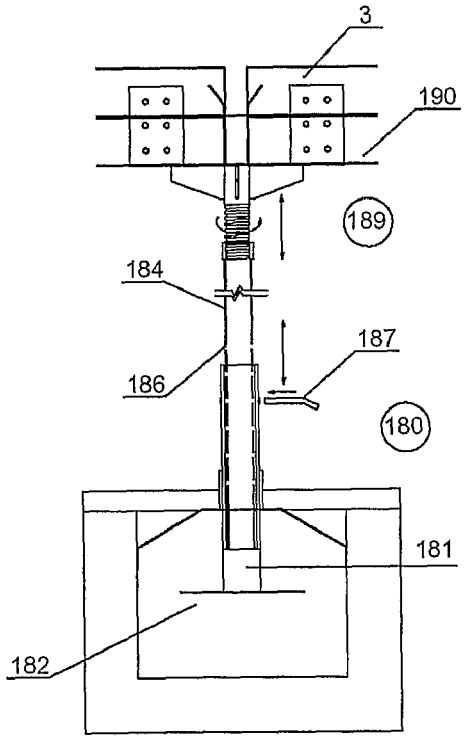

As seen in FIGS. 21A to 21F a further connector or hinge 160 providing 180 degrees rotation is provided. The hinge 160 includes a body 162 having a generally W shape configuration and is connectable within a section 87. At each end of the body 162 are located arms 164 having portions 166 for pivotable attachment to adjacent sections 87 and movement about a radial axis. The section 87 having wall, floor panels or the like being attached thereto. The joint provides a seamless joint as shown in FIG. 21D by the tapered ends of the panels and body 162.

As shown in FIGS. 24A to 24D a cupboard or the like 220 to be located in the enclosure 1 includes a number of rollers 221 to move along a guide 222 to allow movement of the cupboard 220. The cupboard 220 includes a pin 223 to lock the cupboard 220 in place. The cupboard 220 will also provide a complete seal with the walls 224. This provides that cupboards, wardrobes or the like for use in the enclosure 1 are able to slide away from a folding area and fold back without fixing joins.

Figure 25A:
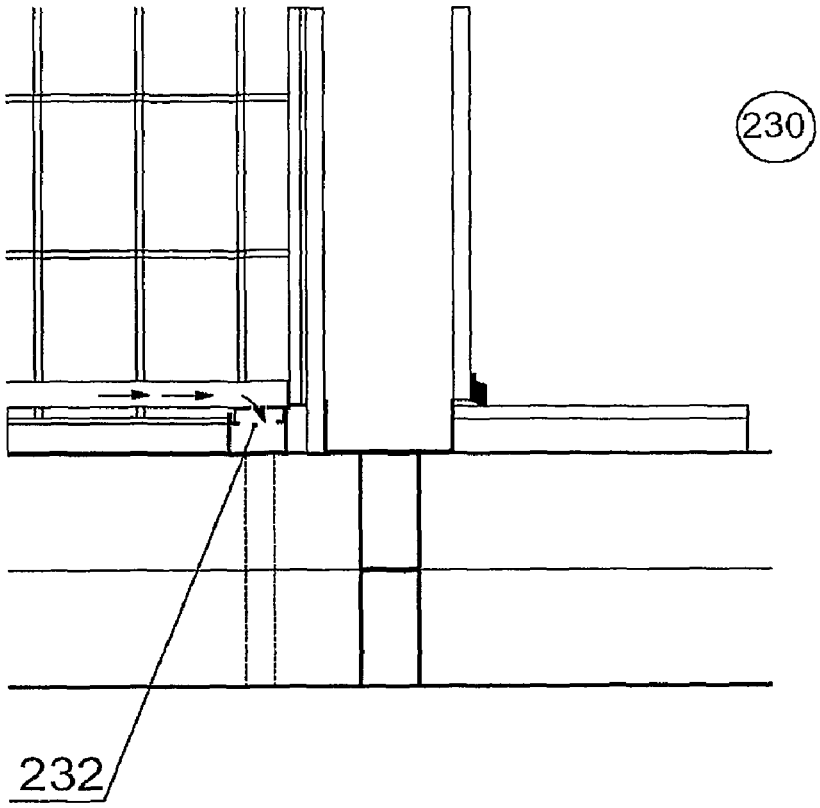
FIGS. 25A and 25B show a bathroom for incorporation into the present invention.
Figure 25B:
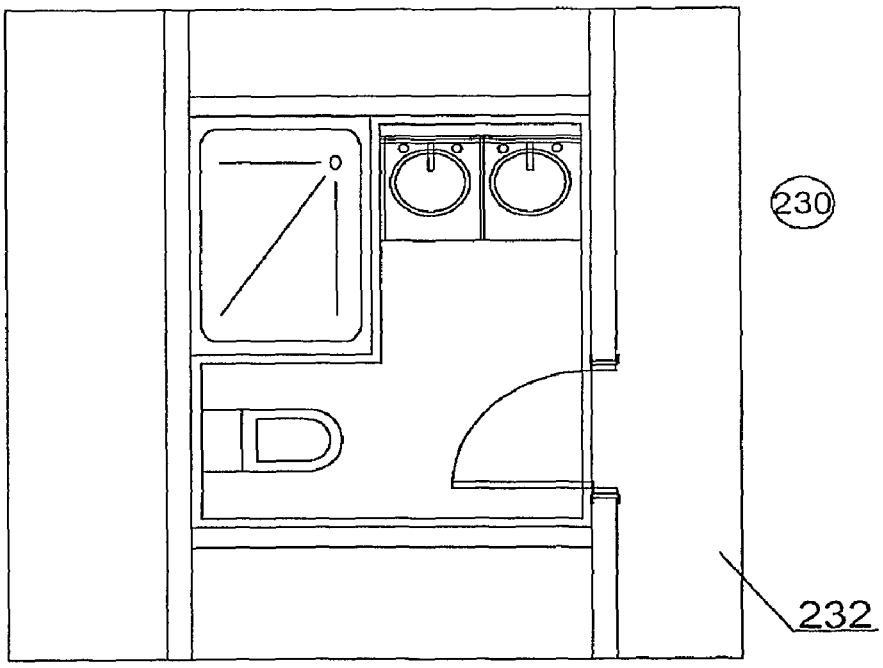

As shown in FIGS. 25A and 25B, a bathroom arrangement 230 which could include a complete waterproofing at the factory with no installation required on site is provided. The bathroom 230 includes a drain 232 spaced around the periphery of the bathroom 230. The drain 232 provides a seal with tiles fixed in place. The drain 232 captures water from the floor and includes a skirting profile replacing the waterproofing membrane and is clipped into the flooring.

As can be seen in FIGS. 22A-22D once the site has been prepared, holes are dug and anchor assemblies 180 are concreted to provide footings. Those anchor assemblies 180 are of any typical type. However, in the embodiments shown they include a first longitudinally extending member 181 secured within the concrete 182 at ground level and have a number of apertures 183 extending therealong. A telescopic member 184 is locatable within the first member 181 and extends longitudinally therefrom. The telescopic member 184 includes corresponding apertures 186 and a locking pin 187 to secure the two members at a particular height above the ground. An anchor pier 189 or the like is secured to the end of the telescoping member 184 and securable to the sub-floor 190 of the enclosure 1. The anchor pier 189 can include adjustment means 192 to be rotated for example to adjust the height of the sub-floor 190 from the ground.

As shown in FIGS. 23A-E, the sub-floor 190 can include two cross-sectional members 194, 195 which are connected to the floor 3 of the enclosure 1. The sub-floor 190 is attached to the anchors 189 providing the height above the ground. A reservoir 59 can be located under the sub-floor 190 and include a flange 198 pivotally connected to a side of the reservoir 59. In the extended position the flanges 198 are locatable within guides 200. Due to the design of the members 194, 195 a reservoir 59 can be easily placed in position or removed at any time.

In use, the enclosure 1 is completely fabricated in an assembly line at an enclosure factory. Once completed in the factory the enclosure 1 is placed within the container 99 in a folded configuration (see for example FIG. 1) for transport to a destination site where the enclosure 1 is to be placed in the expanded configuration (see for example FIG. 9).

Prior to the enclosure 1 arriving at a destination site, the site needs to be prepared to accommodate the arrival of the enclosure 1. The land to accommodate the arrival of the enclosure 1 is prepared and levelled. A pre-built footing frame is placed simultaneously with the pouring of the concrete on the level land. This is completed using guiding plates and level rods incorporated within the footing frame to ensure that the footing frame is placed correctly as well as to reduce the likelihood of any human error.

Purpose built jack stands 180 designed to screw onto the footing frame are now attached. These jack stands 180 are adjustable and accommodate for varying ground height. Attached to the jack stands 180 is a pin to slide onto the pre-fabricated sub-frame 190. Also included are self-guiding plates for the enclosure. The pre-fabricated frame is placed onto the jack stands 180 and adjusted to correct the height. There is no need to screw the frames 190 to the jack stands 180 as they clip in place ensuring accuracy as well as a perfect fit. The pre-fabricated floor frames retain female clipping systems and the pin for the dwelling floor to clip onto. Upon the enclosure 1 arriving a crane lifts the enclosure 1 and places it onto the sub-frame 190. The floor together with its clipping system clips easily without screwing directly onto the prior placed sub-frame 190. The crane dislodges the aforementioned purpose built container 99 which was initially placed over the enclosure 1. The container 99 is located to from the floor 3.

The floor 3 is therefore now located on the frame by way of the clipping system. The crane removes the container 99 from about the enclosure 1. The second floor section 15 and second wall 17 in the folded transport configuration are substantially parallel to each other and the first wall 5 as best seen in FIG. 1. The second floor section 15 and second wall 17 are now pivoted away from the first wall 5 and into the expanded configuration (shown in FIG. 5) by angular movement about their respective hinges in the direction opposite to the direction component so that the second floor 15 is in the same plane as the first floor section 3 and the second wall 17 extends substantially perpendicular upwardly from the second floor section 15.

Figure 11A:
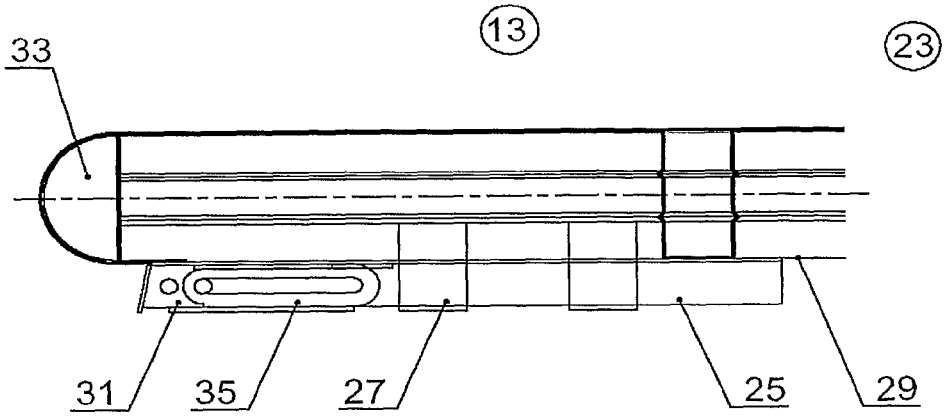
FIGS. 11A to 11C show side views of the movement of the lifting mechanism of the present invention.
Figure 11B:
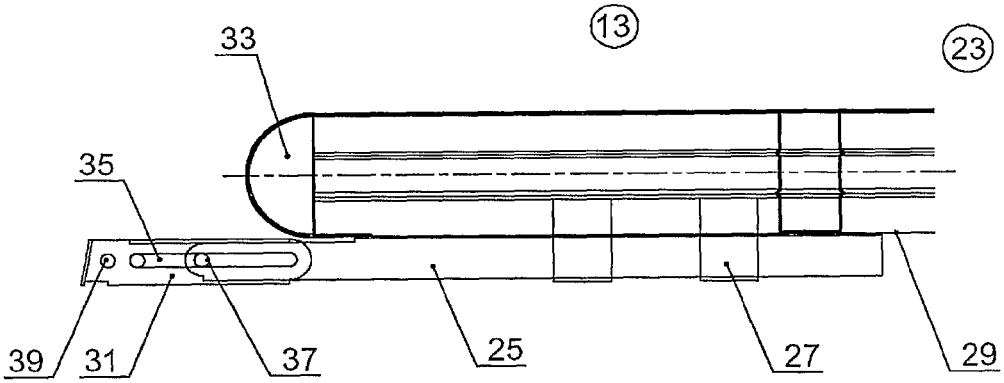
Figure 11C:
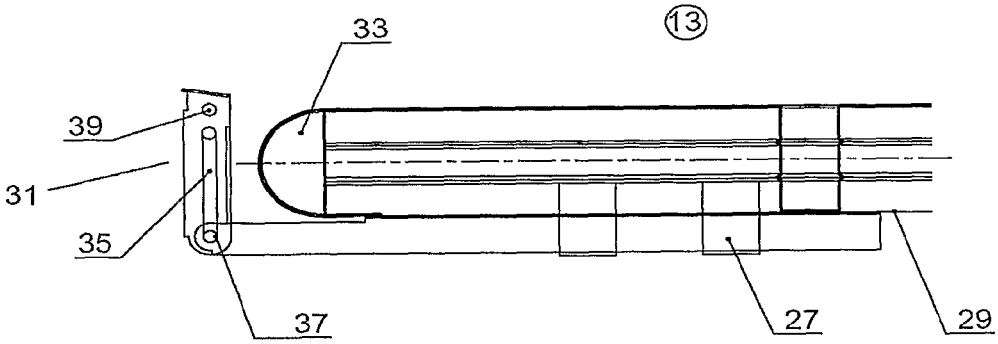
Figure 12A:
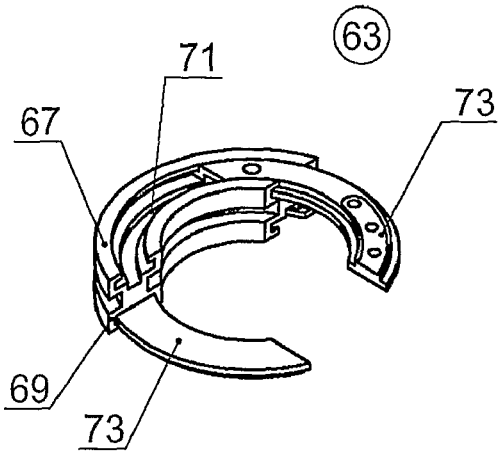
FIGS. 12A to 12E show a roof connector for use in the present invention.
Figure 12B:
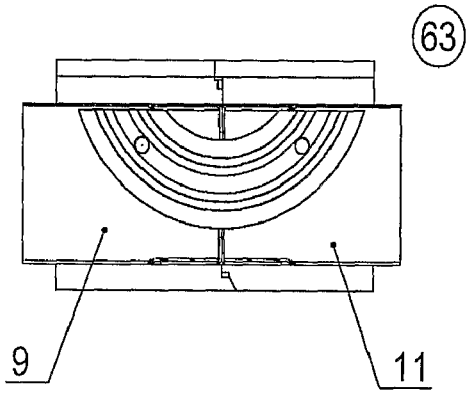
Figure 12D:
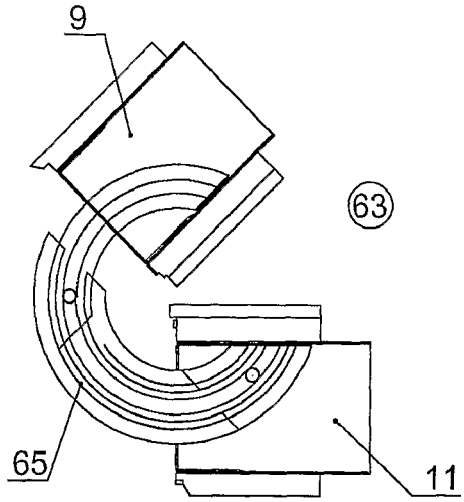
Figure 12C:
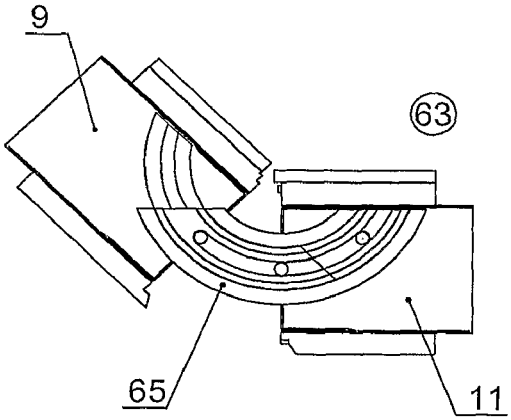
Figure 12E:
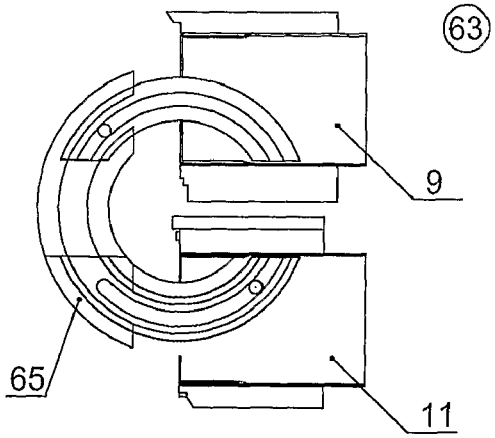

As best seen in FIGS. 11A to 11C, the lifting mechanism 23 is positioned so that the lifting part 31 is substantially perpendicular to the arm 25 so that the crane can connect to the lifting part 31 by way of the hole 39. The crane extends the first, second and third roof portions 9, 11 and 13 which in the folded configuration are at least substantially overlaying each other and extends them to the expanded configuration where the second and third roof portions 11, 13 extend laterally relative to the wall 5 in a direction opposite the direction component of the first roof portion 9. The third roof portion 13 is then connected to the second wall 17 by way of connection 19.

The eave/gutter 53 is then pivoted away from the second wall 17 so that a connection part 101 can be connected to the lifting part 31 of the lifting mechanism 23. As best seen in FIG. 10, the roof sheets 75 are then rolled out from a folded configuration where each sheet 75 at least substantially overlays each other to an expanded configuration where each sheet 75 extends adjacent to each other.

A sliding system (see FIGS. 24A to 24D) enables internal structures such as walls, wardrobes, and the like to be located within the folding area of the container 99 and slide away while being transported and slide back into their finished position once the enclosure 1 is at its destination site.

The utilities for the enclosure 1 are now connected and the internal finishing touches completed. The enclosure 1 is then ready to be occupied.

Advantageously, the present invention at least in a preferred form, provides a relocatable dwelling with the principle application of housing occupants constructed and prefabricated on a production line within a factory. The simplicity of the invention allows incorporation of additional features not normally found on most conventional style dwellings and the inclusion of substantially all fittings prior to leaving the factory. In the preferred form no individual components will be sold separately. The structure of enclosure 1 is of a high grade steel which provides a higher level of endurance than conventional materials currently being used for enclosures 1 and provides a superior ability to transport due to the strength and long lasting characteristics of the material. The enclosure 1 could conceivably include any sized floor space and extensions such as garages, double storeys or the like could be accommodated and could be transported to any location. Further, a range of "green" products such as recycling, solar and wind power features could also be added and incorporated prior to transport. Further, as the enclosure 1 is designed and built in a factory it allows complete customisation for individual consumers.

All the hinges of the enclosure 1 allow 90 degrees and 180 degrees folds leaving the exterior and interior walls and floor without any visible seams. The hinges allow the unfolding process to be the final process as the seams or joins do not require any further finishing or rendering as the joins are considered quite "seamless". The connectors/hinges also provide joining of two panels in a condition which is deemed quite "waterproof" both internally and externally.

The enclosure 1 therefore provides minimal lag time and delay in construction as there is a set procedure for the erection of the enclosure 1 and very little opportunity for human error to occur. As the enclosure 1 would be constructed in a factory on a production line, there is very little lag time from order to delivery and quality control can be assured. Further, there is little variation in the expense to the consumer as problems with materials or weather would not occur. It is also noted that the convex style guttering assembly 51 which is located under the end 33 of the roof portion 13 would have minimal capture of debris and maximum filtration of water and be fireproof. The gutter assembly 51 could also include a filtration system or the like or varying profiles or be manufactured out of different materials. The gutter assembly 51 provides a method of collection rainwater prior to storage in a tank or the like, or for stormwater disposal. Also the assembly 51 incorporates a lifting device 31 which controls during the construction process into the structure of the enclosure 1. The assembly 51 is adhered to the enclosure 1 with the outermost end of the assembly 51 being in line with the outermost end of the roof. Further, the folds, hinges and joints are concealed by way of creating internal and external architectural features. The architectural features are prefabricated with adjoining clips. This means that when dwellings reach the erecting phase it becomes only a simply matter of clipping in place all remaining prefabrications. Thus, the aesthetic aspect as well as the concealing aspect is taken care of in a manner of minutes.

The transport container 99 would also have foldable walls to allow compact return to the factory as well as maximum protection of the enclosure 1. It should be noted that components such as kitchens, bathrooms, doors, windows and fittings or the like would all be completed and installed at the factory and included in the transported container. By use of the clipping system substantial use of screws and bolts have been eliminated. For example, it should be noted that the enclosure 1 can be manufactured of a variety of materials and should not be limited to steel, aluminium, metal or the like. Further, the elements of the enclosure 1 do not need to pivot about a horizontal axis and could also pivot about a vertical axis depending upon the orientation of the enclosure 1.

It should be noted that the enclosure 1 can be re-folded and moved. That is, the folding process mentioned above can be reversed including the roof, walls and other components can be refolded, repacked, reassembled, moved and reconstructed at a different location. The enclosure 1 in the unfolded configuration would be undistinguishable from a typical house constructed using normal techniques.

This invention has been described by means of preferred embodiments which should not be considered limiting to the generality of the description itself. Specific integers referred to throughout the description are deemed to include known equivalents where appropriate. It will be appreciated by those skilled in the art that the invention may be embodied in many other forms.

The invention claimed is:

1. A foldable enclosure that is to be in a folded configuration during transport to a destination site where the enclosure is to be placed in an expanded configuration, said enclosure comprising:

a floor having a first floor section;

at least two roof support sections connected to said floor adjacent opposed sides of said first floor section and extending substantially perpendicular from said floor;

a first roof section connected to ends, distal from said floor, of said at least two roof support sections and spanning across a distance between said two roof support sections;

at least one second roof section pivotally connected to said first roof section or said roof support section and movable between a folded configuration in which said second roof section substantially overlies said first roof section and an expanded configuration in which said second roof section lies substantially in a plane with said first roof section and extending in an opposed direction to that of said first roof section from an adjacent end of said roof support section;

at least one second floor section pivotally connected to or adjacent said side of said first floor section and movable between a folded configuration in which said second roof section lies substantially adjacent said roof support section and an expanded configuration in which said second floor section lies substantially in a plane with said first floor section and extending in an opposed direction to that of said first floor section from an adjacent end of said roof support section; and at least one wall section pivotally connected to said second floor section at an end of said floor section distal from that connected to or adjacent said first floor section and movable between a folded configuration in which said wall section lies substantially adjacent said second floor section and an expanded configuration in which said wall section extends perpendicular from an end of said second floor section to interconnect with an expanded roof section and, wherein said enclosure, when in said folded configuration, is located within a transport container such that a floor section of the floor of the enclosure forms a floor of said transport container.

2. The foldable enclosure as claimed in claim 1 further including a third roof section, pivotally connected to an end of said second roof section at an end of said second roof section distal from that connected to or adjacent said first roof section and movable between a folded configuration in which said third roof section lies substantially adjacent said second floor section and an expanded configuration in which said third roof section extends from an end of said second roof section to interconnect with said at least one wall section.

3. The foldable enclosure as claimed in claim 2 wherein one of said roof portions includes a lifting mechanism for engagement with lifting means operable to move said roof assembly to said expanded configuration.

4. The foldable enclosure as claimed in claim 3 wherein said lifting mechanism includes a longitudinally extending arm for mounting to an underside of said third roof portion, said arm being adapted to slide in a longitudinal direction relative to said third roof portion so that in a first retracted position said arm is positionable under said third roof portion and in a second extended position an end of said arm extends past an end of said third roof portion.

5. The foldable enclosure as claimed in claim 2 including a further hinge for pivotally connecting said first and second roof portions and/or said second and third roof portions, said roof hinge including a body having substantially parallel and laterally spaced apart first and second faces, each said face having an arcuate slot located therein, a pair of complimentary guide members for location within and sliding movement along a respective slot, said guide members operable for movement relative to each other, said guide members for mounting to adjacent roof portions so that in use said roof members are angularly moveable relative to each other about a generally horizontal axis.

6. The foldable enclosure as claimed in claim 1 wherein each said roof portion includes a plurality of roofing sheets and further including a sheet hinge for fixedly connecting adjacent roof sheets and operable for angular movement about a generally horizontal axis.

7. The foldable enclosure as claimed in claim 6 wherein said sheet hinge includes a substantially circular longitudinal extending body having a substantially circular slot extending about said axis, an end of said adjacent sheet being locatable within said slot for angular movement of said adjacent sheets relative to each other and about said axis.

8. The foldable enclosure as claimed in claim 1, wherein said enclosure is a first enclosure, a second enclosure being positionable adjacent said first enclosure and securable thereto to form another enclosure.

* * * * *